US008087269B2

(12) United States Patent
Conti et al.

(10) Patent No.: US 8,087,269 B2
(45) Date of Patent: Jan. 3, 2012

(54) CABLE WRAP SECURITY DEVICE

(75) Inventors: Brian V. Conti, Matthews, NC (US); Ningsheng Zhang, Charlotte, NC (US)

(73) Assignee: Checkpoint Systems, Inc., Thorofare, NJ (US)

( * ) Notice: Subject to any disclaimer, the term of this patent is extended or adjusted under 35 U.S.C. 154(b) by 2 days.

(21) Appl. No.: 12/467,803

(22) Filed: May 18, 2009

(65) Prior Publication Data

US 2009/0223260 A1 Sep. 10, 2009

Related U.S. Application Data

(63) Continuation-in-part of application No. 12/027,296, filed on Feb. 7, 2008.

(51) Int. Cl.
*E05B 73/00* (2006.01)

(52) U.S. Cl. ..... 70/14; 70/49; 70/57.1; 70/58; 70/276; 70/DIG. 49; 242/382; 242/382.1

(58) Field of Classification Search ..... 70/57.1, 70/63, 276, 413, DIG. 49, 14, 18, 30, 49, 70/233; 340/542, 568.2, 571, 652, 572.9, 340/568.4; 242/382, 382.1, 385, 384.7, 385.4
See application file for complete search history.

(56) References Cited

U.S. PATENT DOCUMENTS

| | | | | |
|---|---|---|---|---|
| 3,906,758 | A | 9/1975 | Hurwitt | |
| 4,086,795 | A * | 5/1978 | Foster et al. | 70/233 |
| 4,543,806 | A | 10/1985 | Papandrea et al. | |
| 4,665,724 | A | 5/1987 | Sakai | |
| 4,896,517 | A | 1/1990 | Ling | |
| 5,408,212 | A | 4/1995 | Meyers et al. | |
| 5,473,917 | A | 12/1995 | Say | |
| 5,598,727 | A * | 2/1997 | White | 70/233 |
| 5,610,587 | A | 3/1997 | Fujiuchi et al. | |
| 5,722,266 | A | 3/1998 | Yeager et al. | |
| 5,786,759 | A * | 7/1998 | Ling | 340/542 |
| 5,797,464 | A | 8/1998 | Pratt et al. | |
| 5,960,652 | A | 10/1999 | Marmstad | |

(Continued)

FOREIGN PATENT DOCUMENTS

WO WO 2008/118301 A1 10/2008

(Continued)

OTHER PUBLICATIONS

International Search Report and Written Opinion for Application No. PCT/US2010/034699 mailed Aug. 11, 2010.

*Primary Examiner* — Lloyd Gall
(74) *Attorney, Agent, or Firm* — Alston & Bird LLP

(57) ABSTRACT

A security device may include a spool, locking mechanism, button, plug, and latch. The spool is configured to either wind or unwind a cable for wrapping around an object. The locking mechanism is configured to partially lock the spool. The button may be used to move the locking mechanism between locked and unlocked positions. The button may be blocked by inserting a plug into a housing of the device such that the button can not be activated to unlock the spool. The plug may be secured to the housing through the latch that prevents the unauthorized removal of the plug. For an enhanced locking feature, the latch and the plug may be configured to require at least two forces to move the latch and free the plug. The spool, locking mechanism, and button may be stacked along a common axis to provide a more compacted design.

21 Claims, 18 Drawing Sheets

U.S. PATENT DOCUMENTS

Figure 1A:
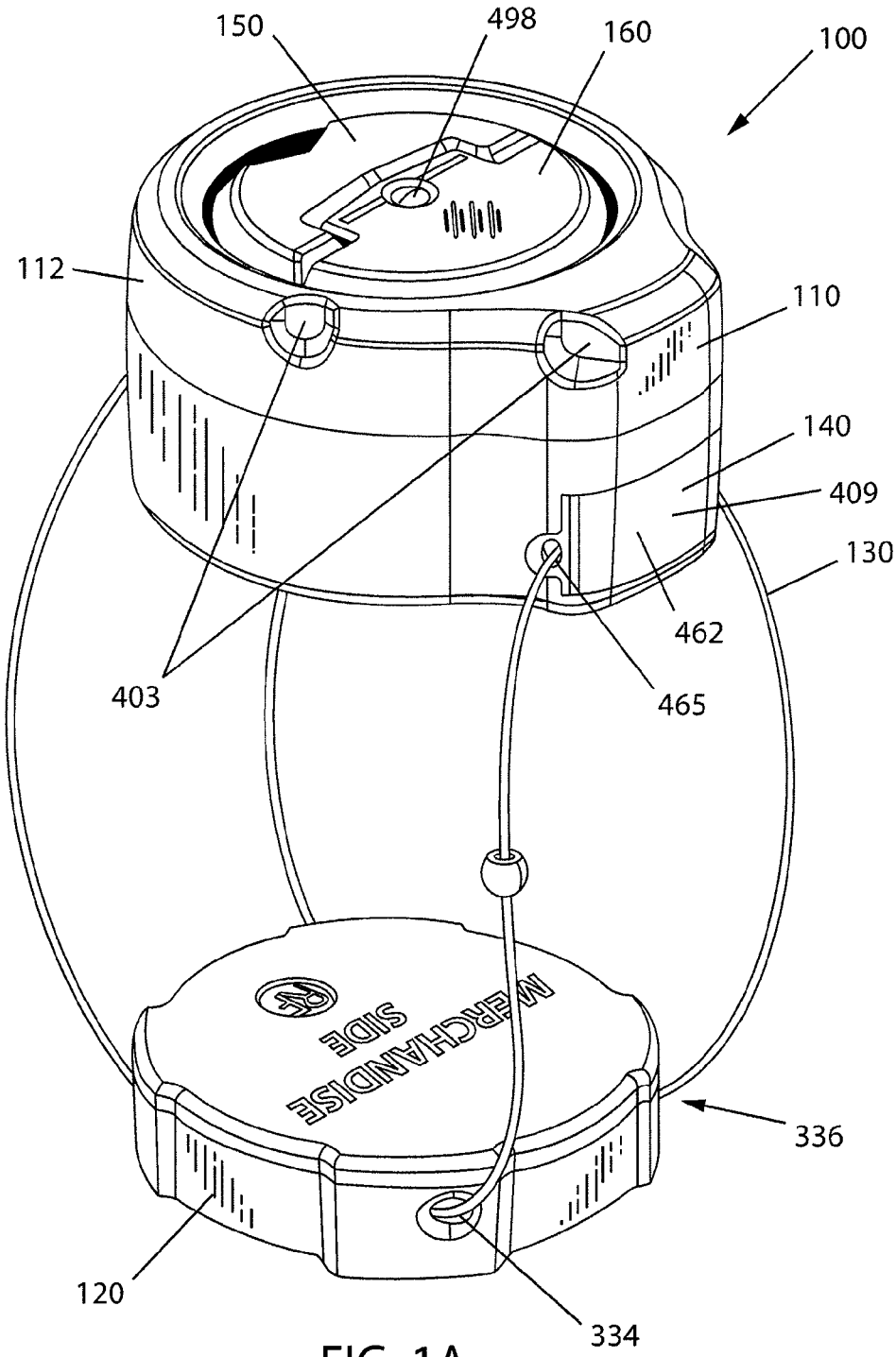

| | | | | |
|---|---|---|---|---|
| 6,681,603 | B1 | 1/2004 | Yu | |
| 7,162,899 | B2 | 1/2007 | Fawcett et al. | |
| 7,168,275 | B2 | 1/2007 | Fawcett et al. | |
| 7,191,623 | B2 | 3/2007 | Francke | |
| 7,251,966 | B2 | 8/2007 | Fawcett et al. | |
| 7,272,962 | B2 | 9/2007 | Benda et al. | |
| 7,350,381 | B2 | 4/2008 | Fawcett et al. | |
| 7,481,086 | B2 | 1/2009 | Fawcett et al. | |
| 7,497,100 | B2 | 3/2009 | Fawcett et al. | |
| 7,497,101 | B2 | 3/2009 | Fawcett et al. | |
| 7,685,850 | B2 * | 3/2010 | Nilsson | 70/18 |
| 2005/0223756 | A1 | 10/2005 | Ling et al. | |
| 2006/0137409 | A1 | 6/2006 | Fawcett et al. | |
| 2006/0137411 | A1 | 6/2006 | Fawcett et al. | |
| 2006/0169008 | A1 | 8/2006 | Fawcett et al. | |
| 2007/0039360 | A1 | 2/2007 | Fawcett et al. | |
| 2007/0069529 | A1 | 3/2007 | Nilsson | |
| 2007/0101775 | A1 | 5/2007 | Fawcett et al. | |
| 2007/0107477 | A1 | 5/2007 | Fawcett et al. | |
| 2008/0034815 | A1 | 2/2008 | Fawcett et al. | |
| 2008/0236209 | A1 | 10/2008 | Conti et al. | |
| 2008/0251623 | A1 | 10/2008 | Goldstein et al. | |
| 2010/0101283 | A1 * | 4/2010 | Xiaobin | 70/14 |

FOREIGN PATENT DOCUMENTS

| | | | |
|---|---|---|---|
| WO | WO 2008/142713 | A1 | 11/2008 |

* cited by examiner

CABLE WRAP SECURITY DEVICE

CROSS-REFERENCE TO RELATED APPLICATION

The present application is a continuation-in-part application of U.S. application Ser. No. 12/027,296 filed on Feb. 7, 2008. U.S. application Ser. No. 12/027,296 is hereby incorporated by reference in its entirety.

BACKGROUND

1. Field of the Invention

The present invention relates to security devices used to protect merchandise or other objects and, more particularly, to security devices having one or more adjustable cables used to wrap around the objects such that the security devices are secured to the objects.

2. Description of Related Art

Electronic article surveillance (EAS) systems are often used to deter and detect shoplifting. Typically, an EAS security system includes an EAS tag, a transmitter, a receiver, and an alarm. The EAS tag is attached to a piece of merchandise. The transmitter and the receiver are positioned at the exit of a retail establishment and configured to establish a detection zone in which a consumer must pass through as he or she exits the retail establishment. The transmitter is configured to send signals through the detection zone. When an EAS tag enters the detection zone, the EAS tag responds and creates a signal or a change or disturbance in the original signal transmitted by the transmitter, which is detectable by the receiver. Upon detection of the EAS tag, the alarm is triggered in order to notify the store personnel that someone is trying to exit the retail establishment with merchandise that has an attached and active EAS tag.

In an EAS system, it is the actual EAS tag that is being detected and not the merchandise itself. Therefore, an EAS system can be circumvented by removing the EAS tag from the merchandise. To prevent the unauthorized removal of the EAS tag, security devices have been developed. A typical security device is configured to house the EAS tag and attach the EAS tag to the merchandise in a manner that limits the likelihood that a consumer or a would-be thief could tamper with or otherwise remove the EAS tag from the merchandise.

As an example, one particular type of security device is a cable wrap security device such as the one disclosed in U.S. Pat. No. 7,497,101, which is hereby incorporated by reference in its entirety. Typically, a cable wrap security device includes a first housing for a ratchet mechanism, a second housing for an EAS tag, and a cable that is routed through both the first and second housing and configured to wrap around the package of the merchandise. The ratchet mechanism is configured to tighten the cable around the package such that the security device is not removable from the package without being loosened. The security device further includes a locking mechanism that prevents loosening or release of the cable without a specifically configured key or other specialized equipment that is controlled by the employees of the retail establishment. In some applications, the cable of the cable wrap security device also prevents a consumer or would-be thief from opening or otherwise tampering with the package to get to the merchandise within the package.

BRIEF SUMMARY

Embodiments of the present invention provide a security device. The security device is configured to secure to merchandise or other objects and to prevent the unauthorized removal or tampering of the security device. Moreover, the security device according to embodiments of the present invention may also provide one or more additional features or functionalities that a retail operator may prefer or consider prior to the use or selection of a particular security device over others.

For example, according to an embodiment, a security device structured for attachment to an object is provided. The security device includes a housing, a spool, a locking mechanism, a button, a plug, and a latch. The spool is rotatably supported within the housing such that the spool is rotatable in both a first direction and a second direction. The locking mechanism is movable between a locked position and an unlocked position. In the locked position, the locking mechanism is positioned to prevent the spool from rotating in the first direction while not preventing the spool from rotating in the second direction. In the unlocked position, the locking mechanism is positioned to not prevent the spool from rotating in the first direction or in the second direction. The button is accessible from outside of the housing when the security device is unattached to the object and configured to move the locking mechanism between the locked position and the unlocked position. The plug is movable between an inserted position and a removed position. In the inserted position, at least a portion of the plug is positioned to prevent the button from moving the locking mechanism out of the locked position. In the removed position, the plug is positioned to not prevent the button from moving the locking mechanism out of the locked position. The latch is movable between an engaged position and a disengaged position. In the engaged position, at least a portion of the latch is positioned to prevent the plug from moving toward the removed position. In the disengaged position, the latch is positioned to not prevent the plug from moving toward the removed position.

The latch, in the engaged position, and the plug, in the inserted position, may be configured to require a first force and a second force to move the latch from the engaged position toward the disengaged position.

The security device may further include a cable that is configured to form at least one cable loop extending from the housing and to at least the plug. A first end of the cable may be connected to the spool and a second end of the cable may be secured, e.g., to a non-rotatable portion of the housing or other component of the security device, such that a rotation of the spool in the first direction lengthens the cable loop and a rotation of the spool in the second direction shortens the cable loop.

The button may be positioned to be inaccessible once the security device is attached to the object.

Each of the spool, the locking mechanism, and the button may share is spatially centered about a common axis. The locking mechanism may be moveable along the common axis. In the inserted position, the plug may be generally perpendicular to the common axis. The latch may be moveable along an axis parallel to the common axis.

The security device may further include at least one of an EAS tag and audio alarm. The security device may further include a second housing. The first housing may contain the audio alarm and the second housing may contain the EAS tag.

According to another embodiment, the security device includes a housing, a spool, a handle, a locking mechanism, a button, and a plug. The spool is rotatably supported within the housing such that the spool is rotatable in both a first direction and a second direction about a first axis. The handle is configured to rotate the spool. The locking mechanism is movable along the first axis between a locked position and an unlocked position. In the locked position, the locking mechanism is positioned to prevent the spool from rotating in the first direction while not preventing the spool from rotating in the second direction. In the unlocked position, the locking mechanism is positioned to not prevent the spool from rotating in the first direction or in the second direction. The button is accessible from outside of the housing when the security device is unattached from the object, movable along the first axis, and configured to move the locking mechanism between the locked position to the unlocked position. The plug is movable between an inserted position and a removed position. In the inserted position, at least a portion of the plug is positioned to prevent the button from moving the locking mechanism out of the locked position. In the removed position, the plug is positioned to not prevent the button from moving the locking mechanism out of the locked position.

The security device may further include a cable and a latch. The cable is configured to form at least one cable loop extending from the housing and to at least the plug. A first end of the cable is connected to the spool and a second end of the cable is secured such that a rotation of the spool in the first direction lengthens the cable loop and a rotation of the spool in the second direction shortens the cable loop. The latch is movable between an engaged position and a disengaged position. In the engaged position, at least a portion of the latch is positioned to prevent the plug from moving toward the removed position. In the disengaged position, the latch is positioned to not prevent the plug from moving toward the removed position.

The latch, in the engaged position, and the plug, in the inserted position, may be configured to require a first force and a second force to move the latch from the engaged position toward the disengaged position. In the inserted position, the plug may be generally perpendicular to the first axis.

In another embodiment, the security device may include a housing, a spool, a locking mechanism, a button, and a plug. The spool is rotatably supported within the housing such that the spool is rotatable about a first axis in both a first direction and a second direction. The locking mechanism is movable between a locked position and an unlocked position. In the locked position, the locking mechanism is positioned to prevent the spool from rotating in the first direction while not preventing the spool from rotating in the second direction. In the unlocked position, the locking mechanism is positioned to not prevent the spool from rotating in the first direction or in the second direction. The button is accessible from outside of the housing when the security device is unattached to the object, movable and configured to move the locking mechanism between the locked position and the unlocked position. The plug is movable between an inserted position and a removed position. In the inserted position, the plug extends generally perpendicular to the first axis and between the button and the locking mechanism such that the button is prevented from moving the locking mechanism out of the locked position. In the removed position, the plug is positioned to not prevent movement of the button.

Each of the locking mechanism and the button may be moveable along the first axis.

The security device may further include a latch movable between an engaged position and a disengaged position. In the engaged position, at least a portion of the latch is positioned to prevent the plug from moving toward the removed position. In the disengaged position, the latch is positioned to not prevent the plug from moving toward the removed position. The latch, in the engaged position, and the plug, in the inserted position, may be configured to require a first force and a second force to move the latch from the engaged position toward the disengaged position.

The security device may further include a handle and a cable. The handle may be configured to rotate the spool. The cable may be configured to form at least one cable loop extending from the housing and to at least the plug. For example, a first end of the cable may be connected to the spool and a second end of the cable may be secured such that a rotation of the spool in the first direction lengthens the cable loop and a rotation of the spool in the second direction shortens the cable loop.

The security device may further an EAS tag and a second housing that contains the EAS tag. The security device may also include an audible alarm.

BRIEF DESCRIPTION OF THE SEVERAL VIEWS OF THE DRAWING(S)

Figure 1B:
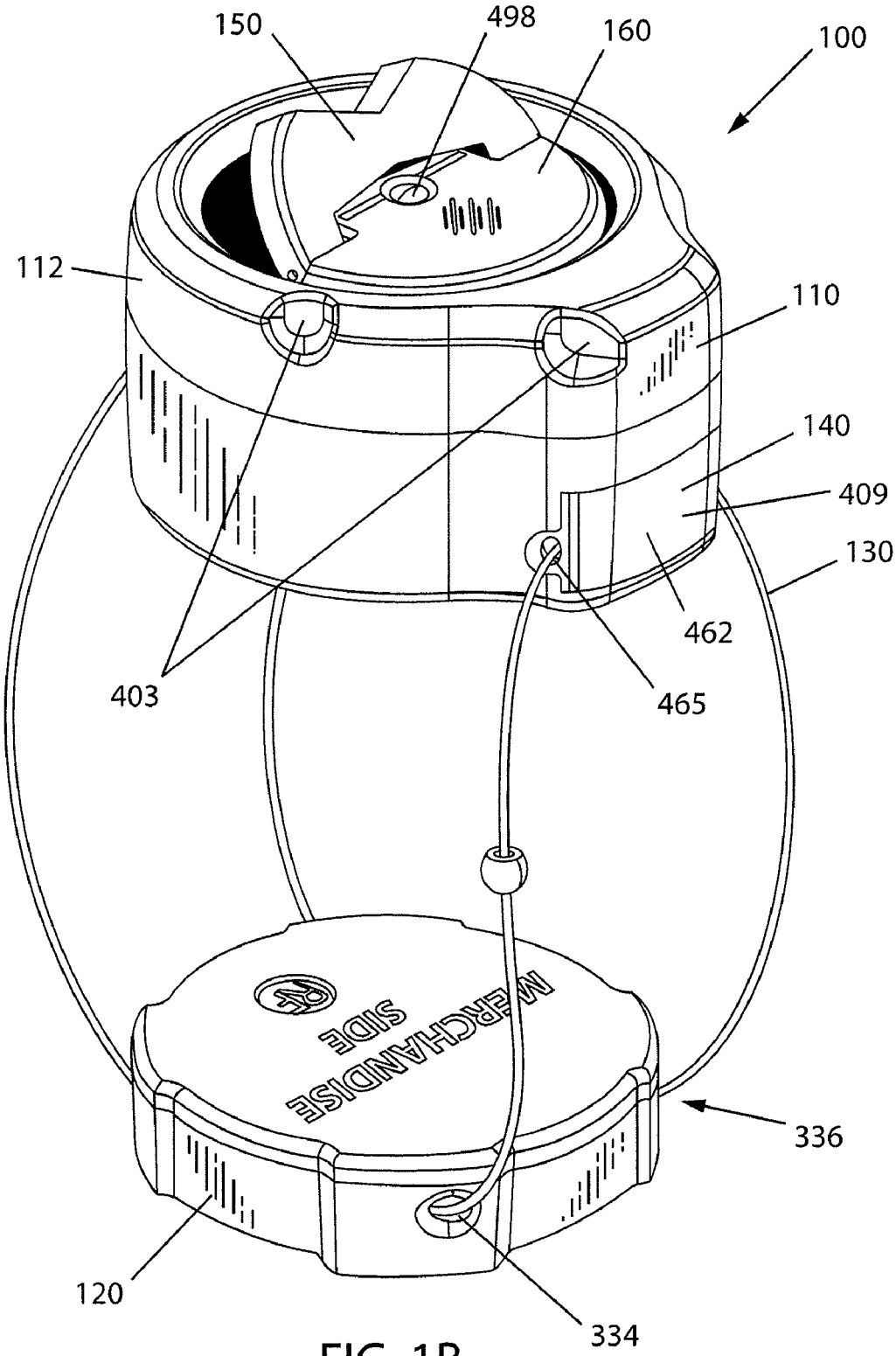
Figure 2A:
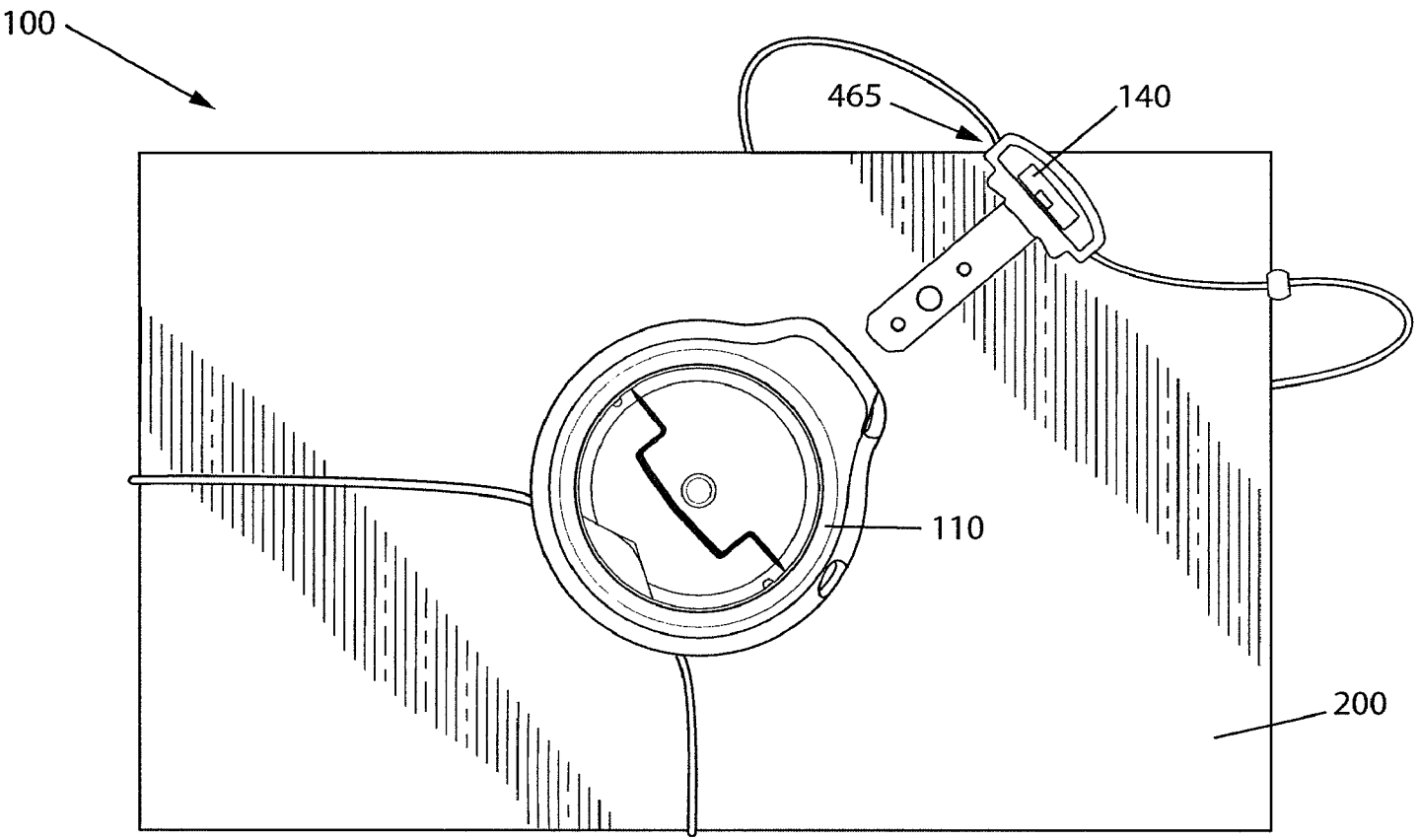
Figure 2B:
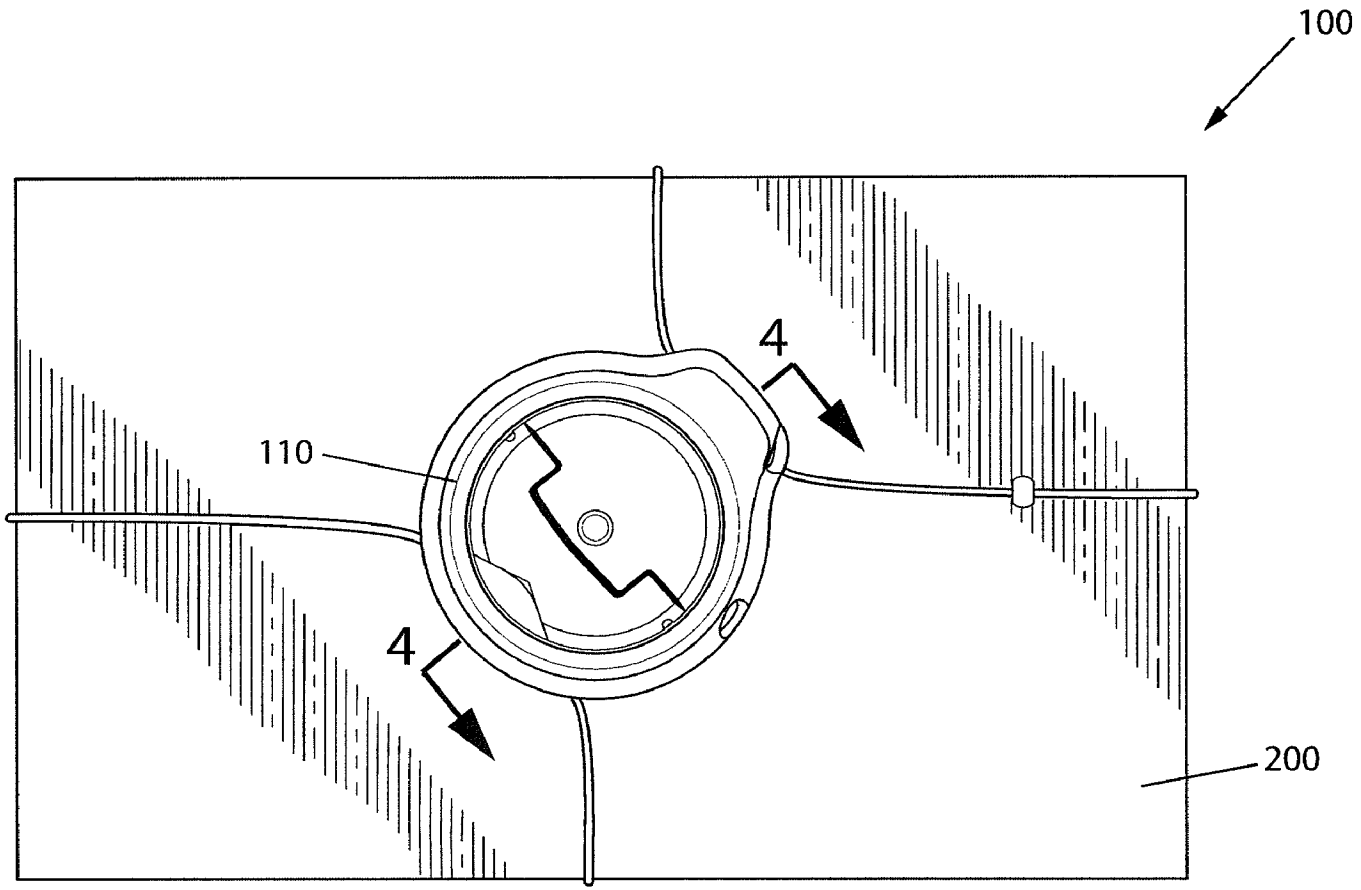
Figure 2C:
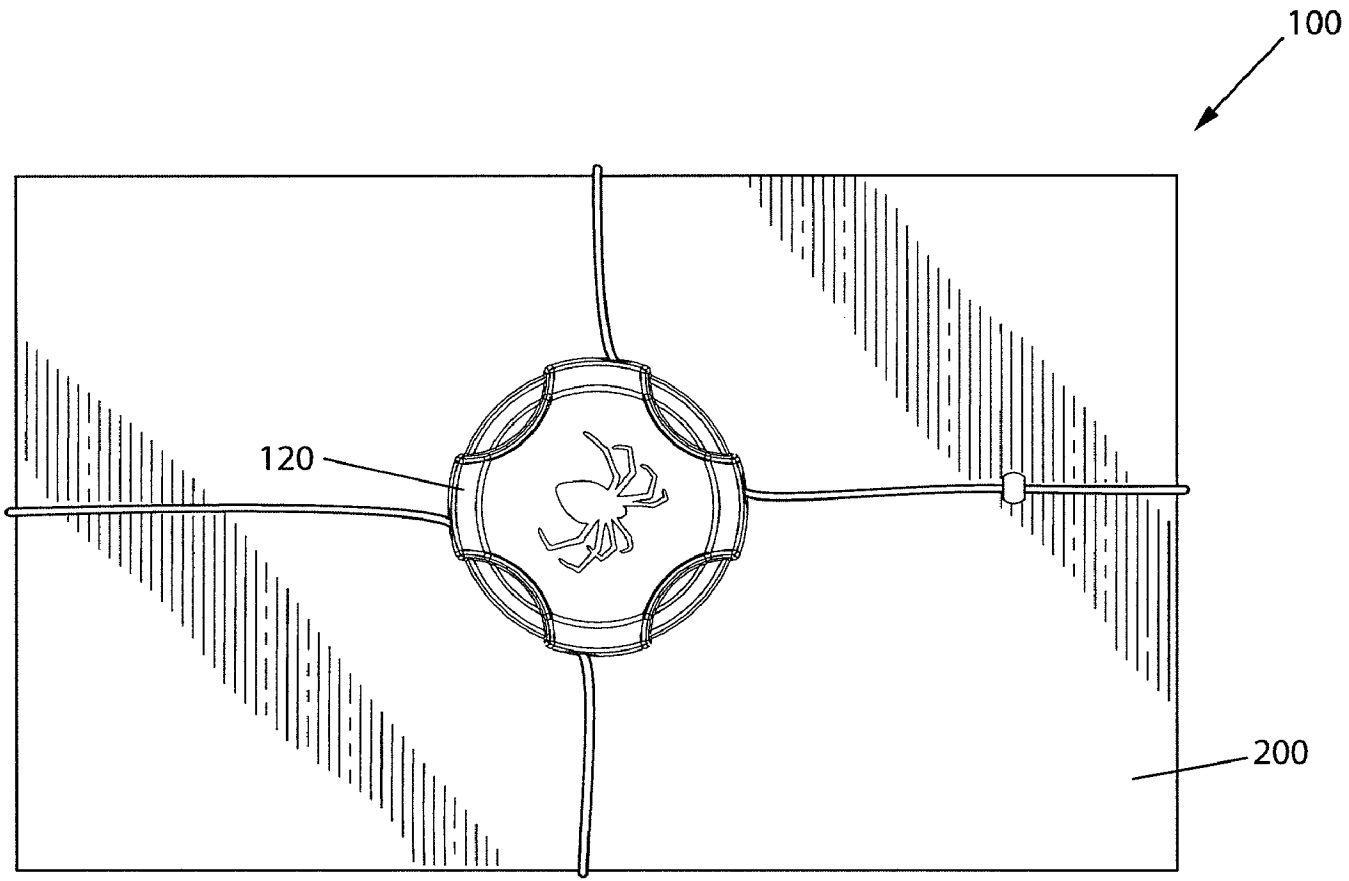

Reference will now be made to the accompanying drawings, which are not necessarily drawn to scale, and wherein:

FIG. 1*a* is a perspective view of a security device according to an exemplary embodiment of the present invention;

FIG. 1*b* is the security device of FIG. 1*a* with the handle in a partial flipped up position;

FIG. 2*a* is a front view of the security device of FIG. 1*a* partially wrapped around an object;

FIG. 2*b* is the same front view of FIG. 2*a* with the security device completely wrapped around the object;

FIG. 2*c* is a back view of FIG. 2*b;*

Figure 3A:
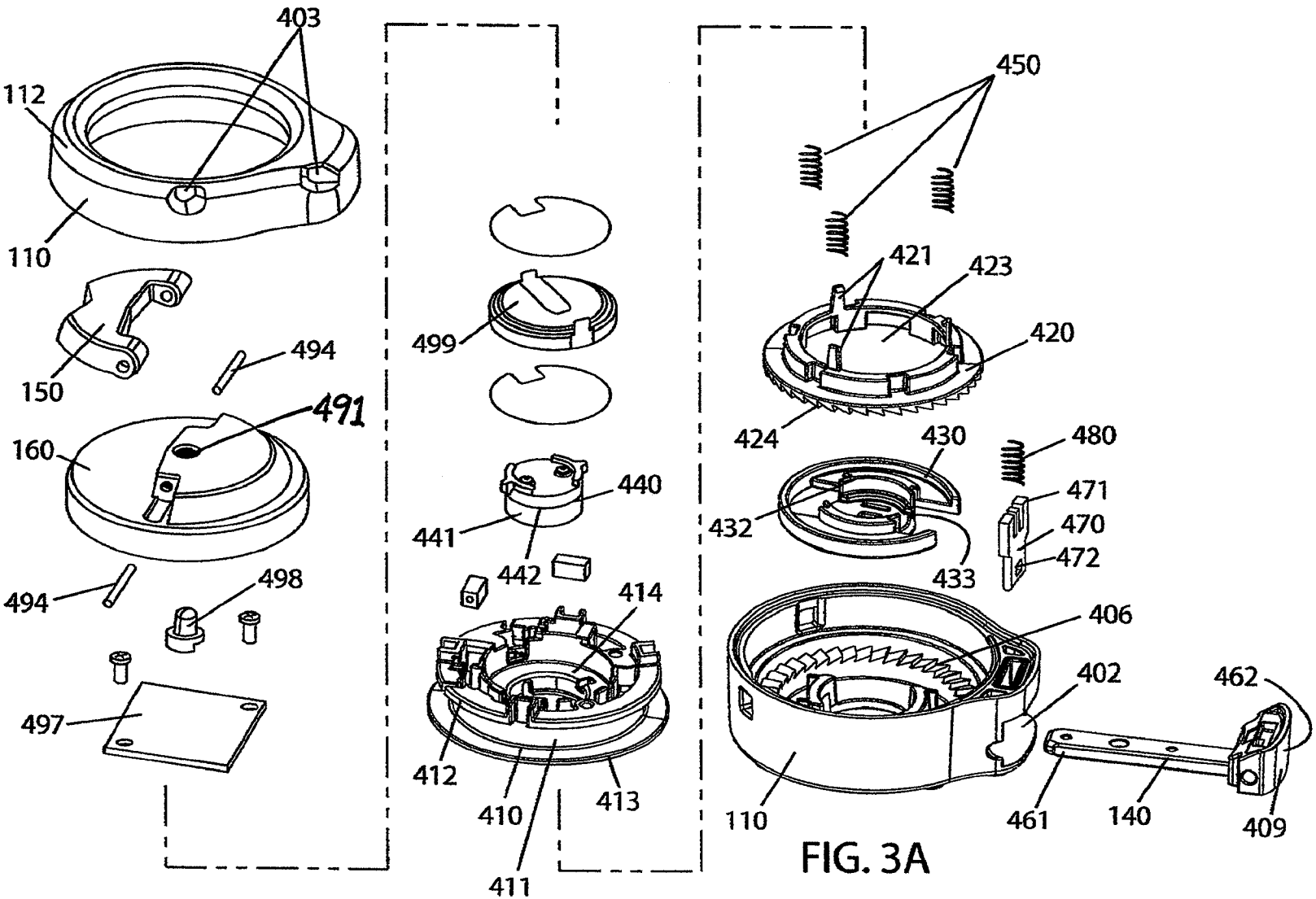

FIG. 3*a* is an exploded view of a first housing of the security device of FIG. 1*a;*

Figure 3B:
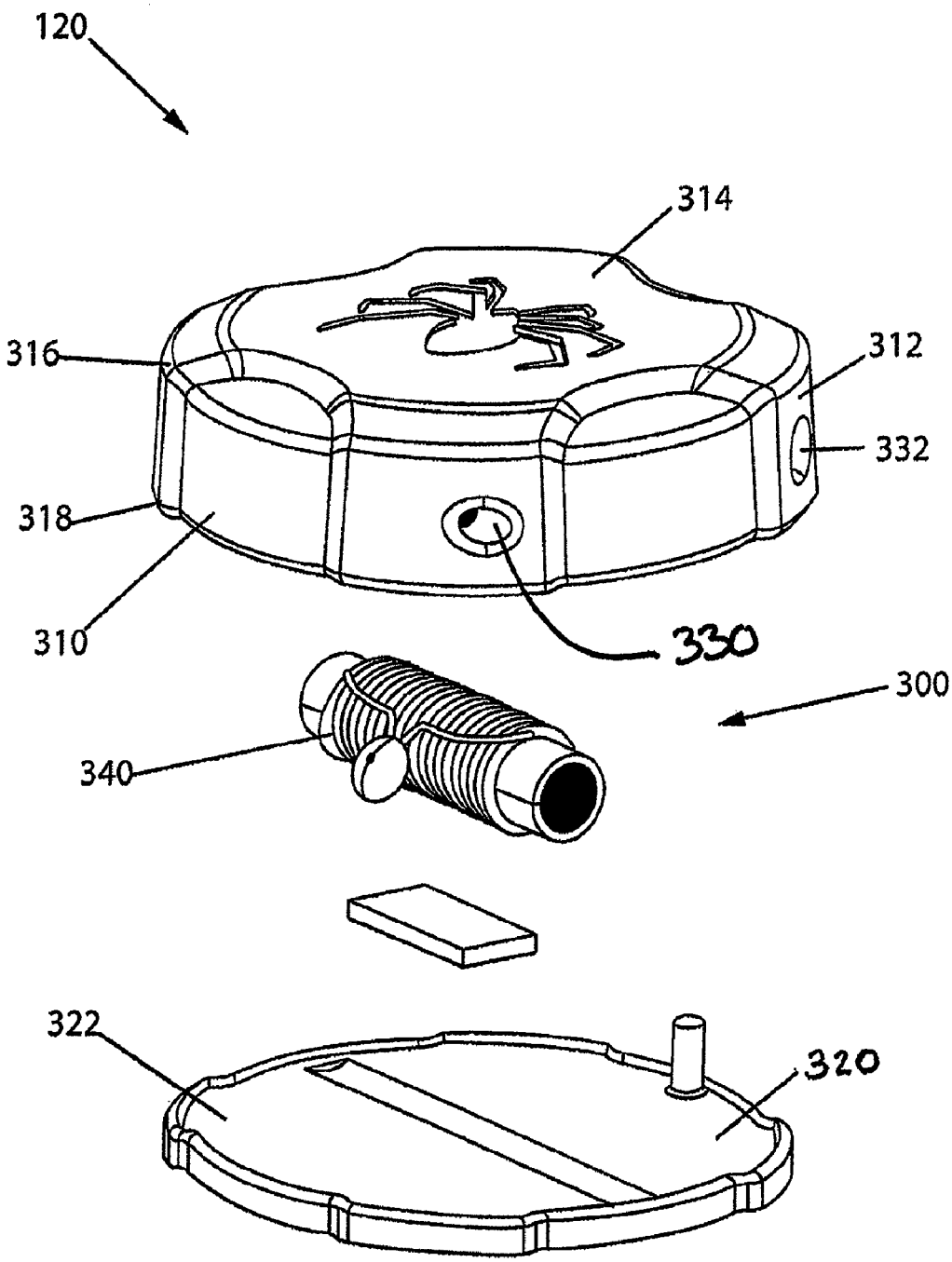

FIG. 3*b* is an exploded view of a second housing of the security device of FIG. 1*a;*

Figure 4A:
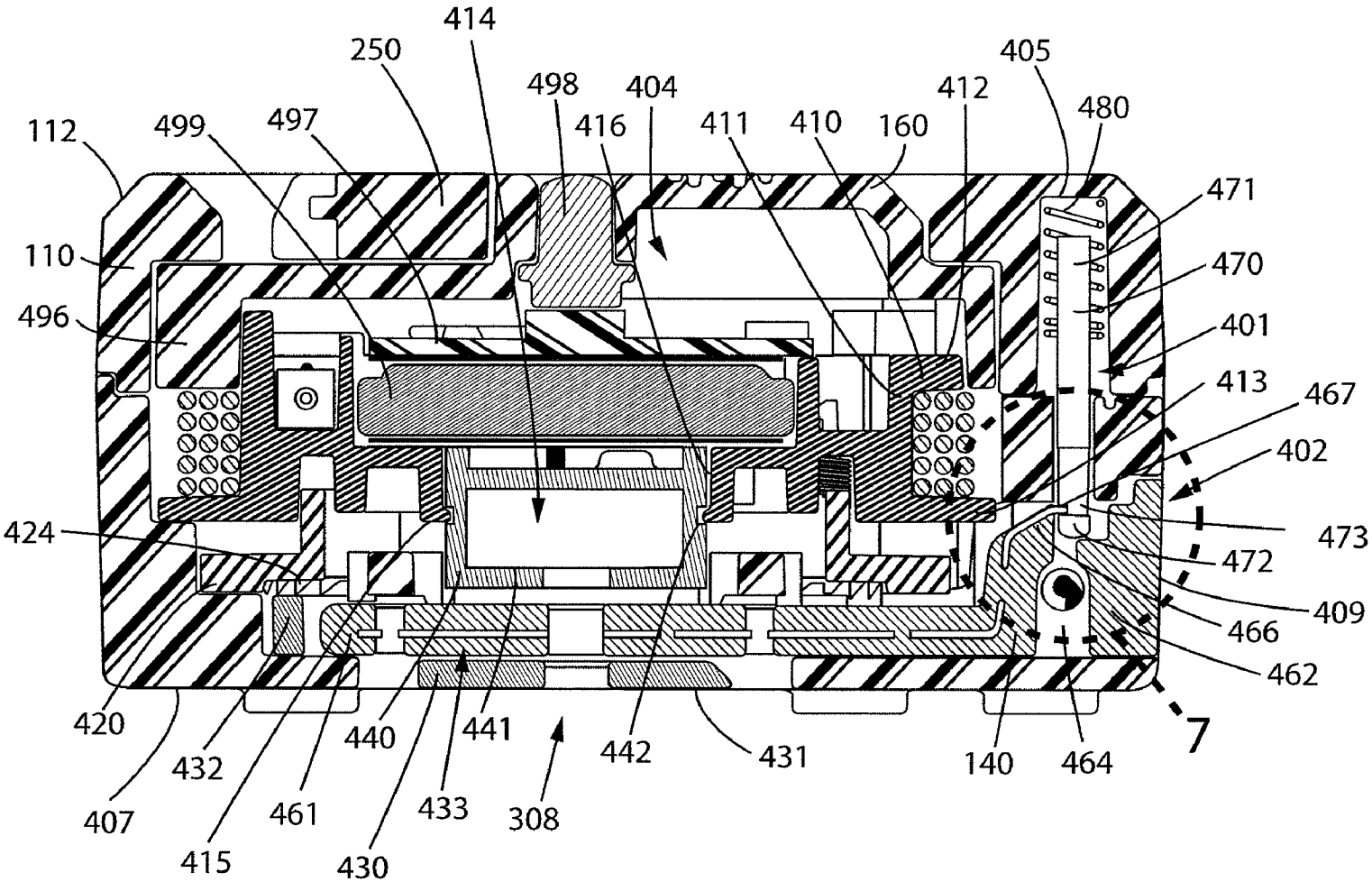

FIG. 4*a* is a cross-section view of the first housing taken along line 4-4 of FIG. 2*b;*

Figure 4B:
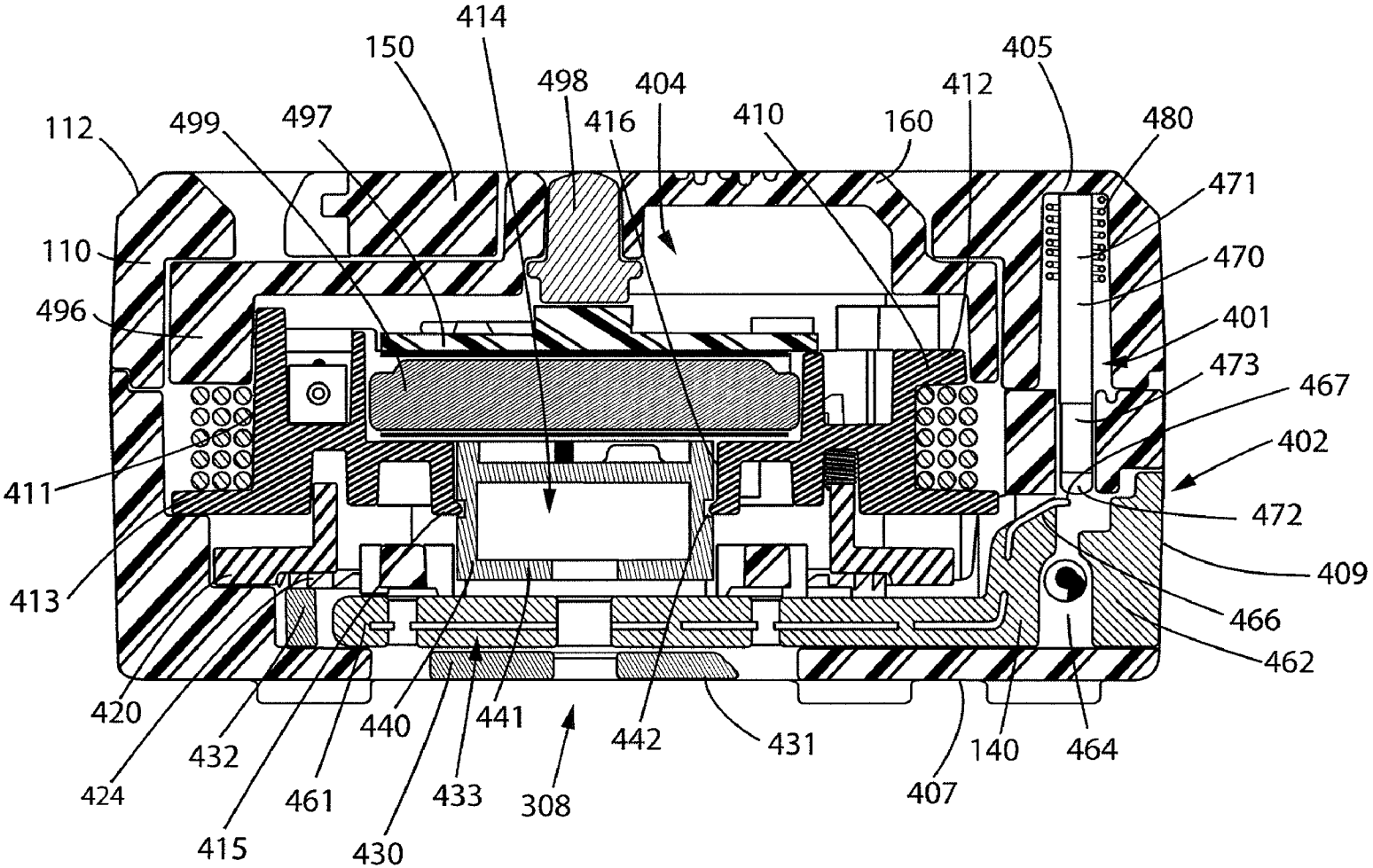
Figure 4C:
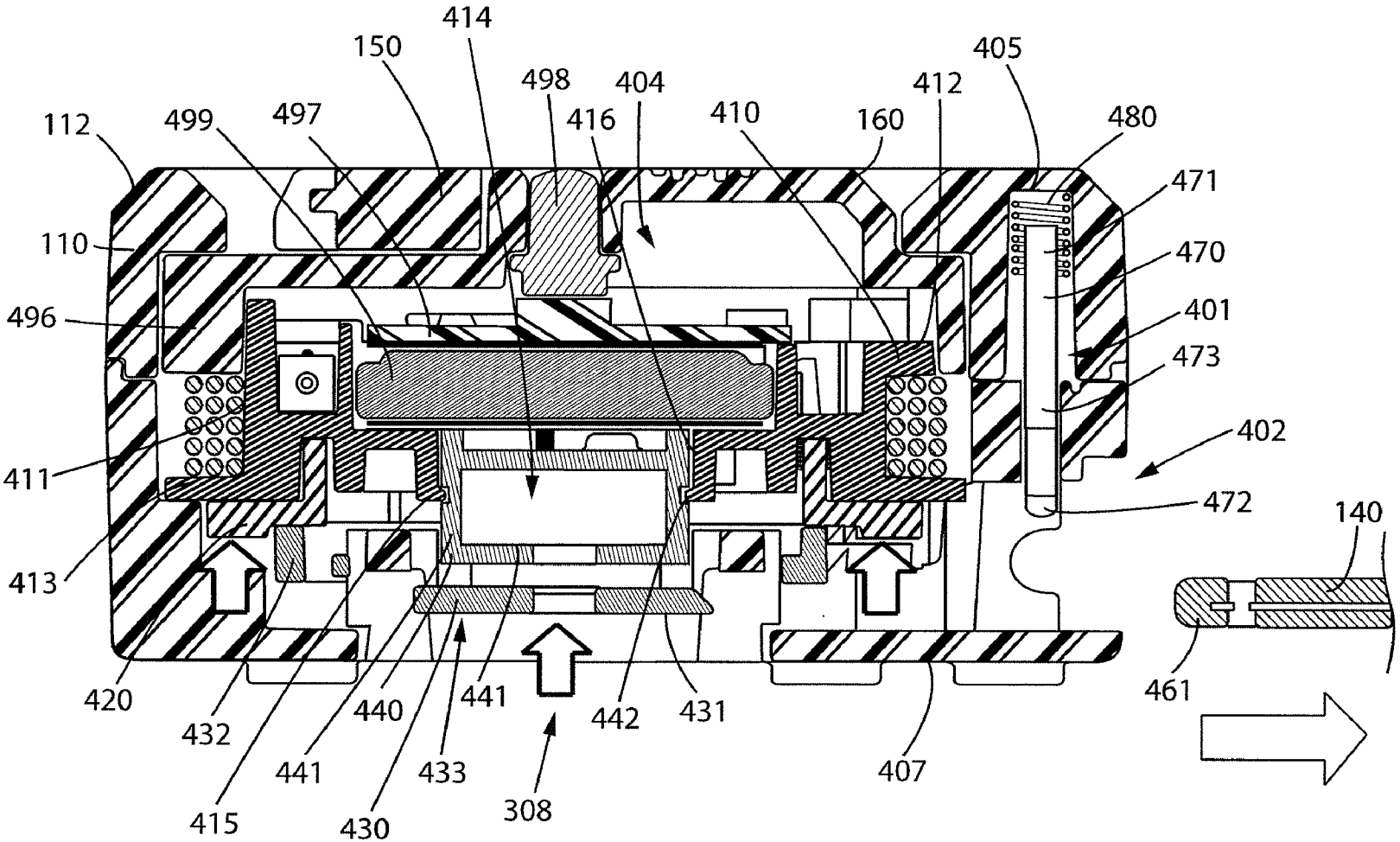
Figure 5A:
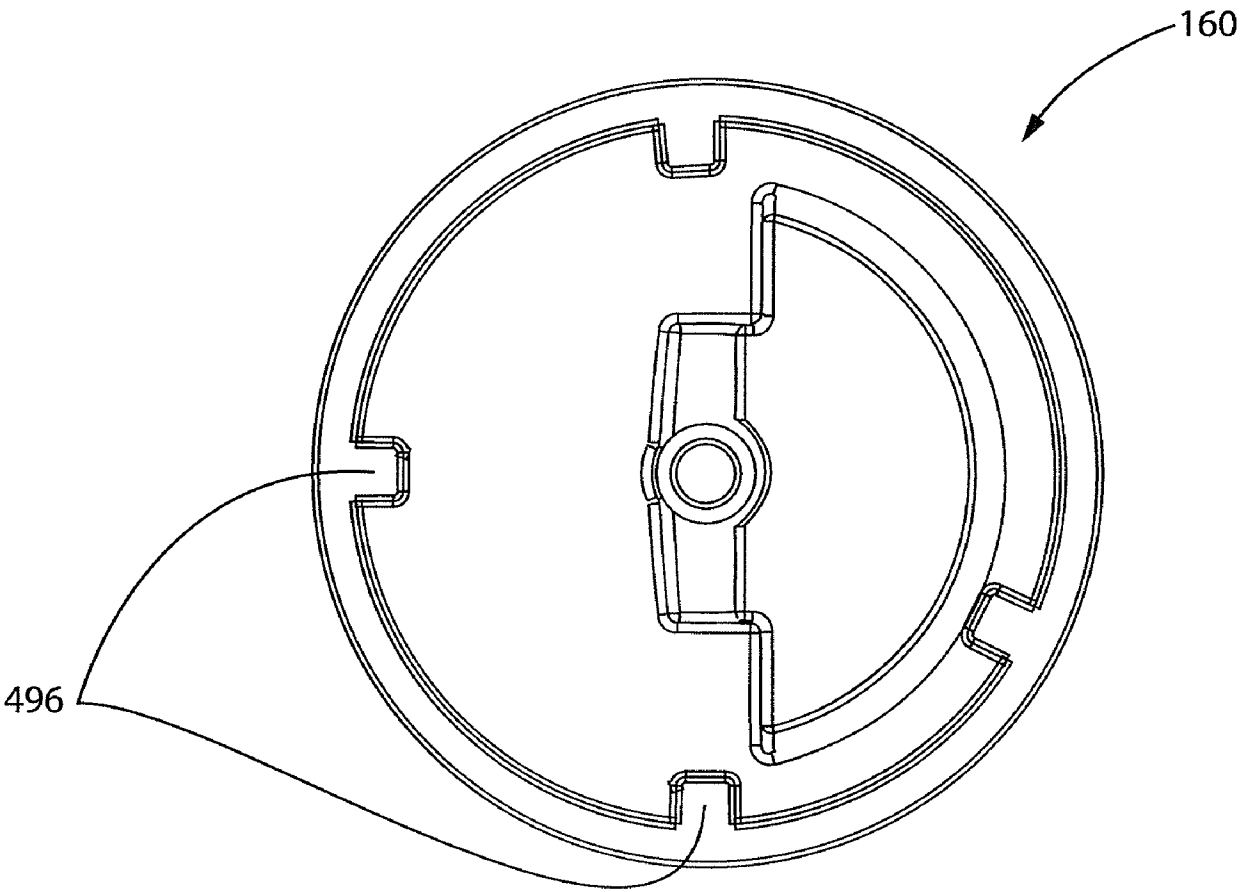

FIG. 4*b* is the cross-section view of FIG. 4*a* with a latch of the security device in a disengaged position;

FIG. 4*c* is the cross-section view of FIG. 4*a* with the latch of the security device in the disengaged position and a plug of the security device removed;

FIG. 5*a* is a bottom plan view of a top of the security device of FIG. 1*a;*

Figure 5B:
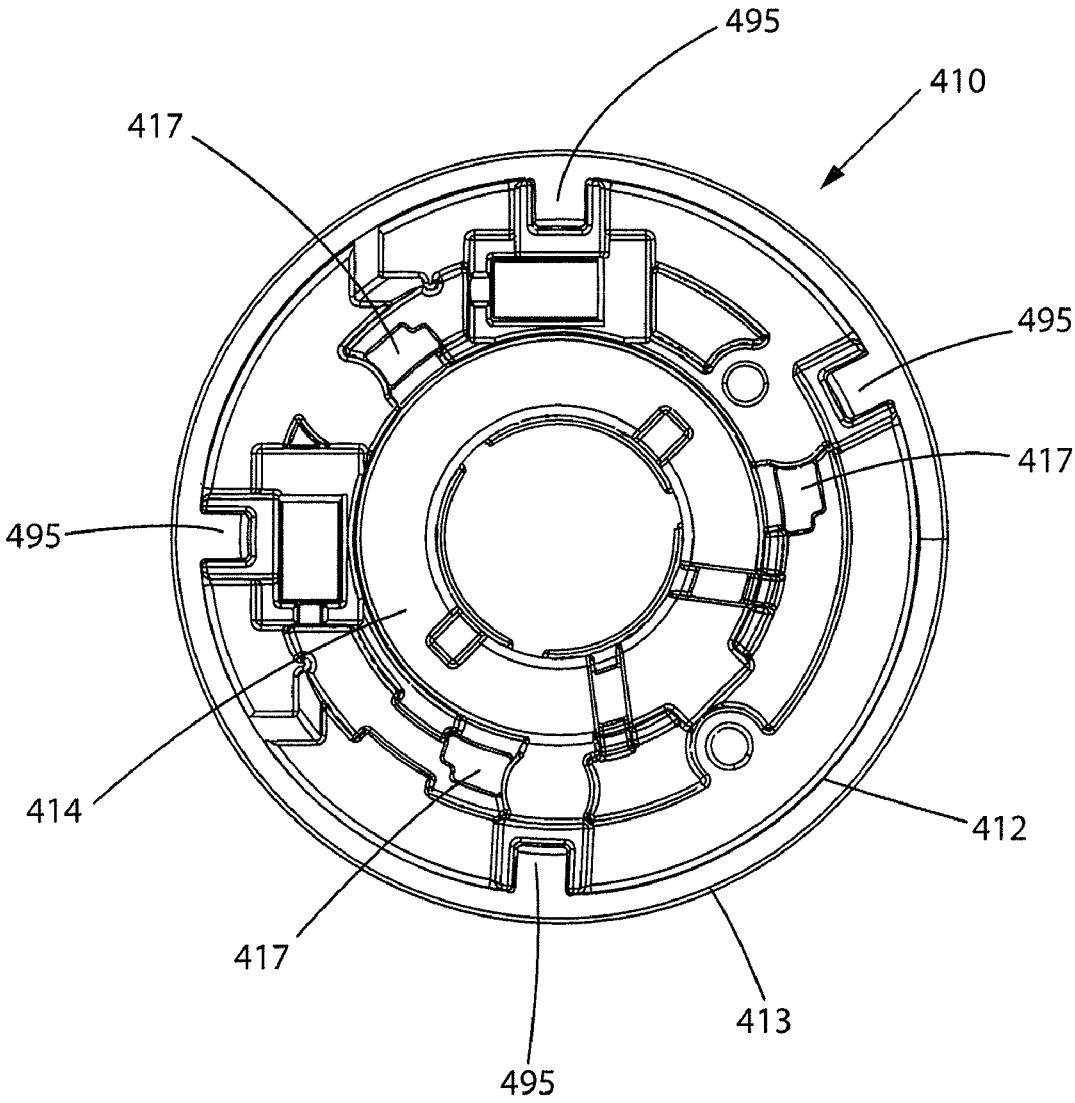

FIG. 5*b* is a top plan view of a spool of the security device of FIG. 1*a;*

Figure 5C:
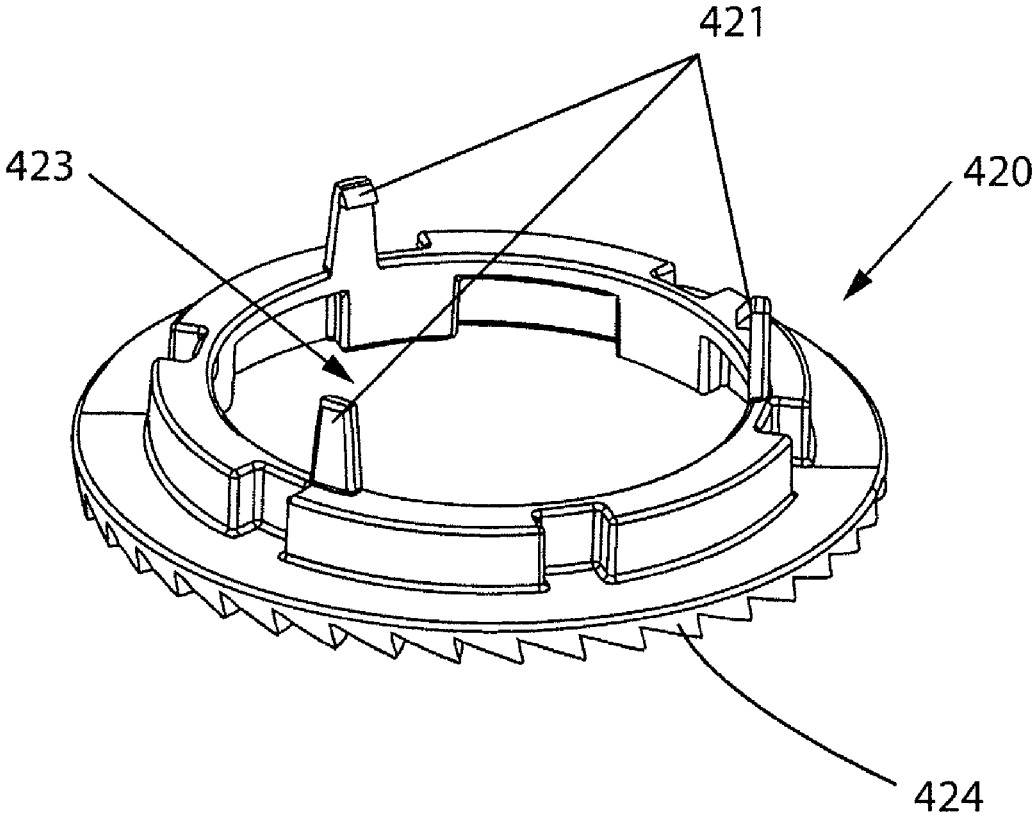

FIG. 5*c* is a perspective view of a locking mechanism of the security device of FIG. 1*a;*

Figure 5D:
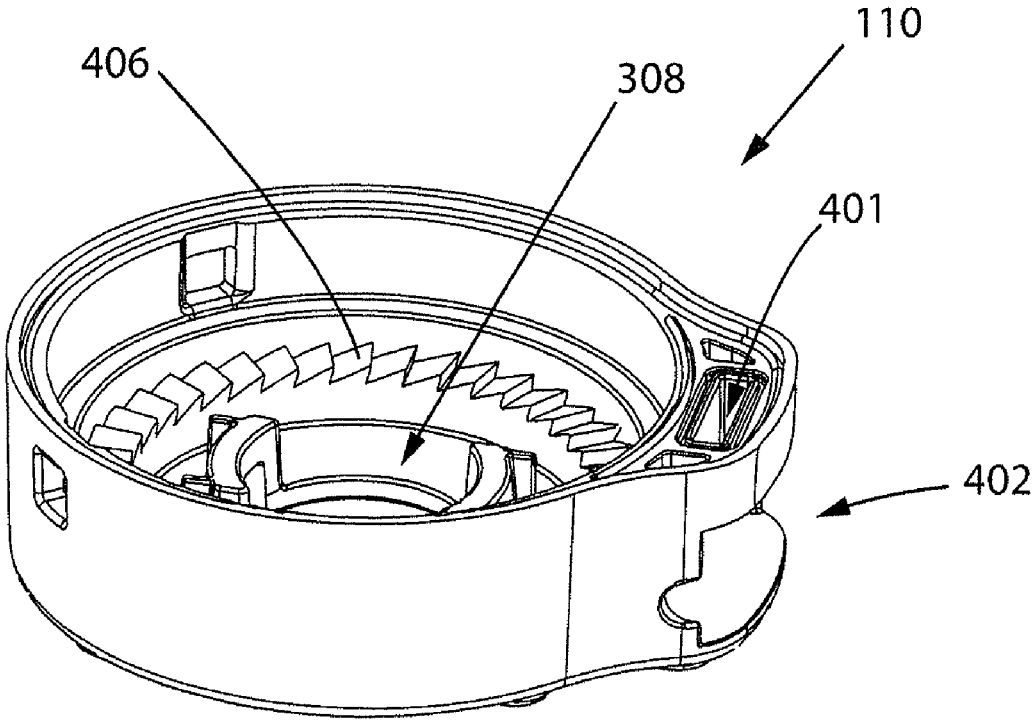

FIG. 5*d* is a perspective view of a portion of the first housing of the security device of FIG. 1*a;*

Figure 6A:
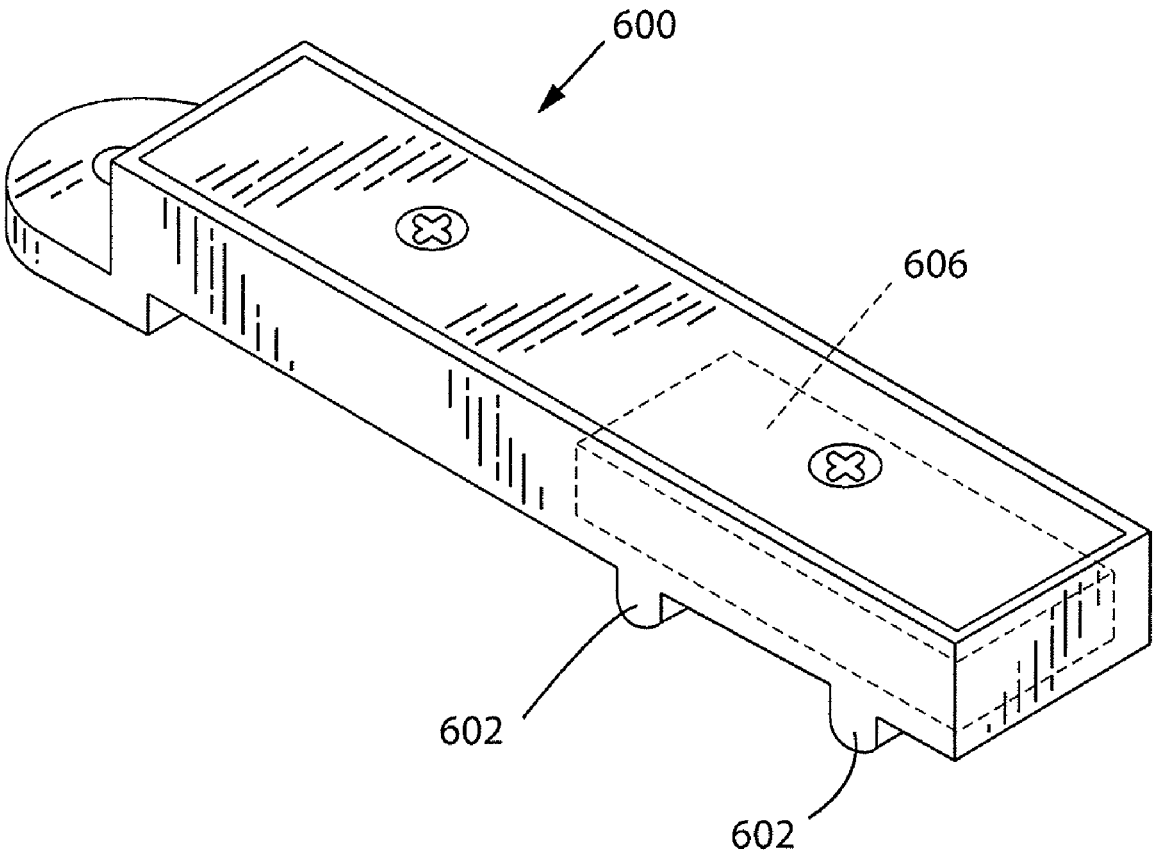
Figure 6B:
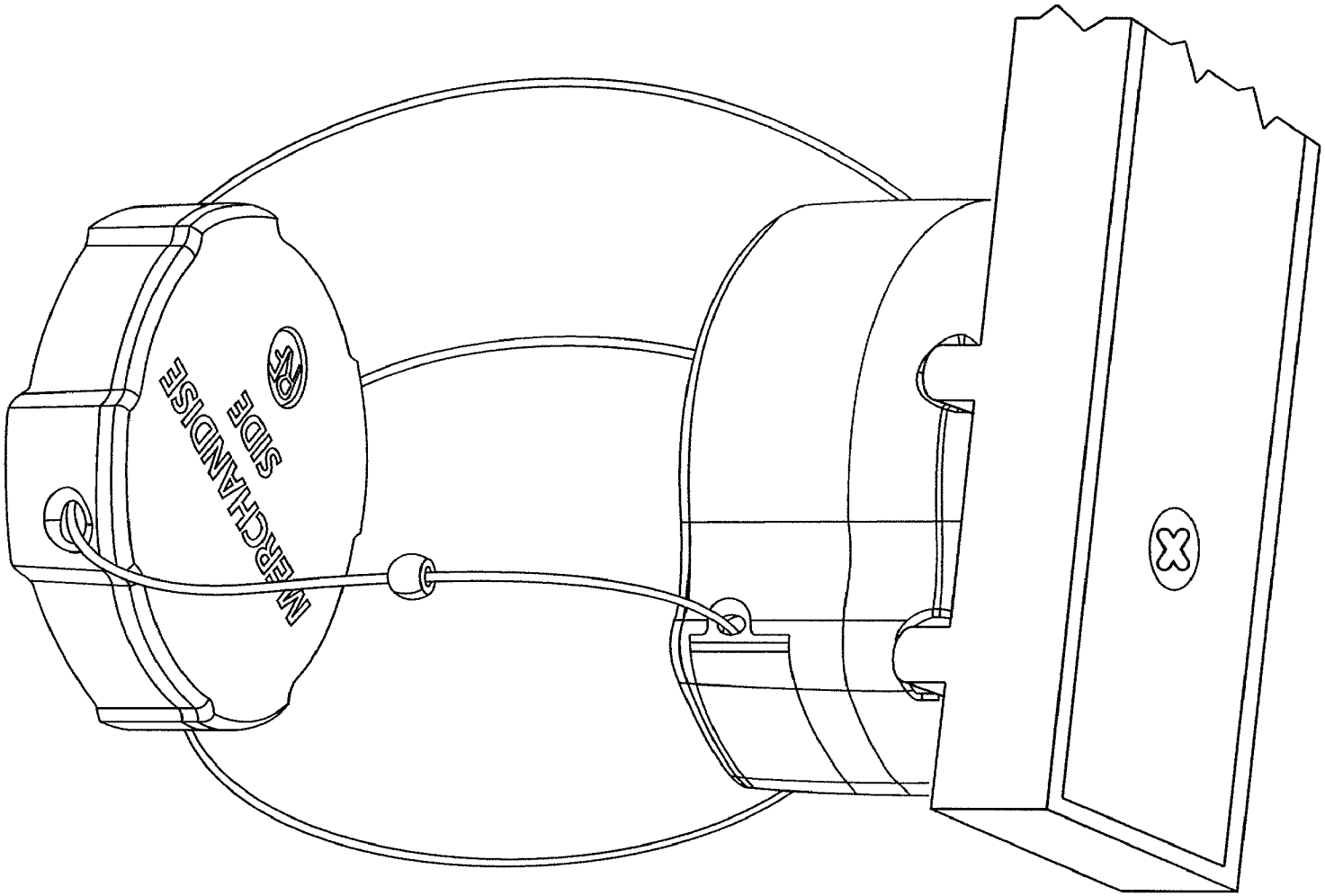
Figure 6C:
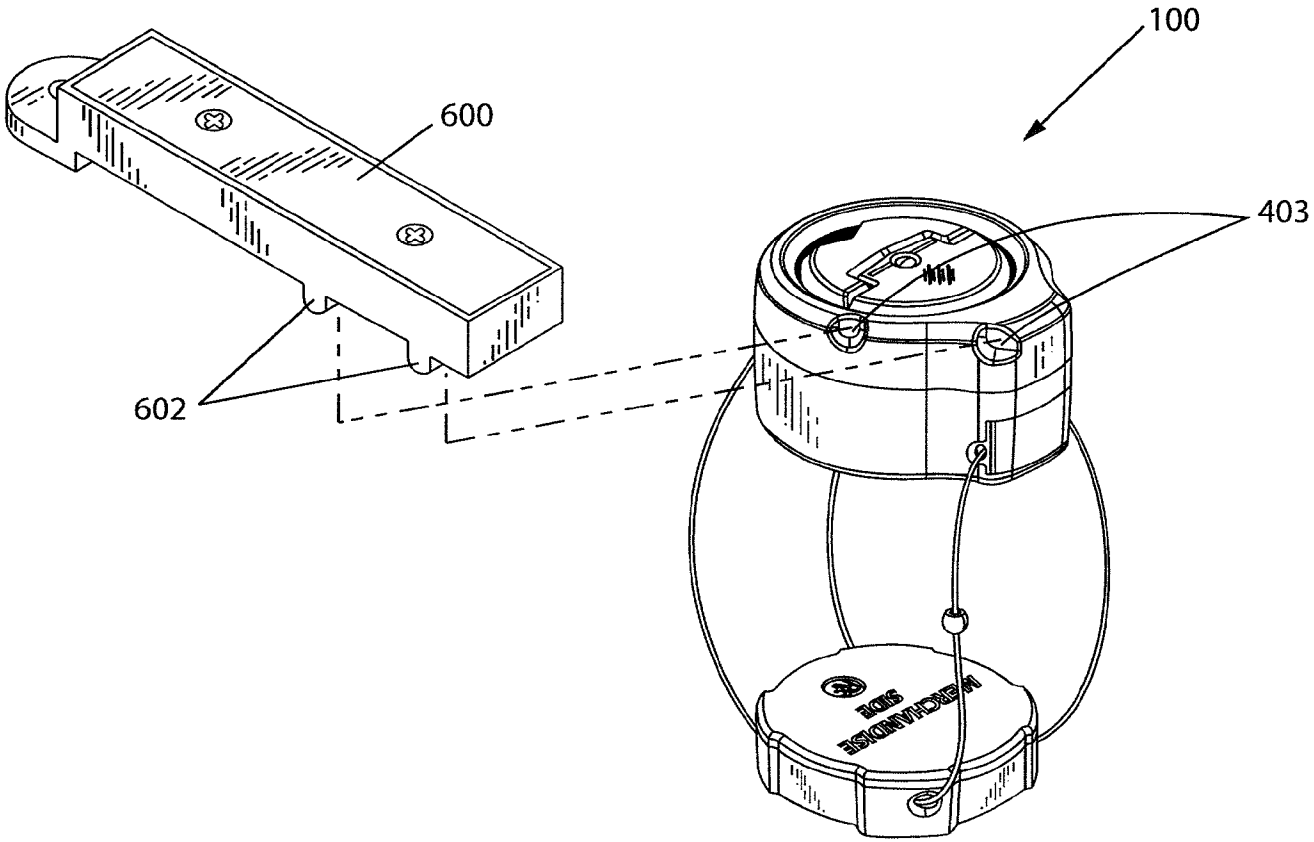

FIG. 6*a* is a perspective view of a specifically configured key consistent with an exemplary embodiment of the present invention;

FIG. 6*b* is the view of FIG. 1*a* with the key of FIG. 6*a* applied;

FIG. 6*c* is an exploded view of FIG. 6*b*; and

Figure 7:
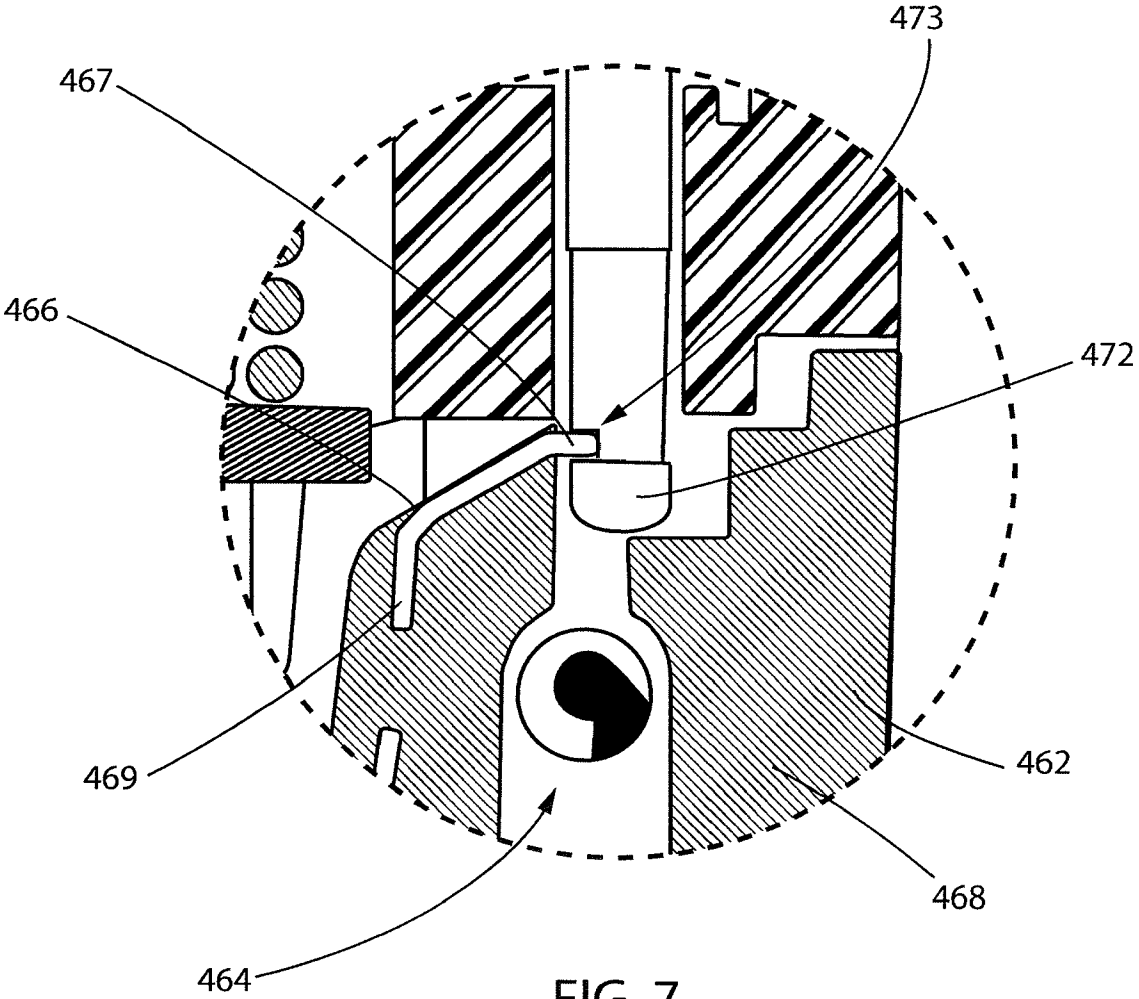

FIG. 7 is an enlarged view of the highlighted area 7 of FIG. 4*a.*

DETAILED DESCRIPTION

The present invention or inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout. The terms top, bottom, side, up, down, upwards, downwards, vertical, horizontal, and the like as used below do not imply a required limitation in all embodiments of the present invention but rather are used herein to help describe relative direction or orientation in the exemplary embodiment illustrated in the figures.

Embodiments of the present invention provide a security device. The security device may be configured to secure to merchandise or other objects and to prevent the unauthorized removal or tampering of the security device. The security device may further include one or more alarm features. Moreover, the security device according to embodiments of the present invention may also provide other features or functionalities that a retail operator may prefer or consider prior to the use or selection of a particular security device over others. For example, while the security device is configured to prevent unauthorized removal, the ease at which an authorized operator, such as an employee, can remove the security device may be factor. Similar, the ease at which the security device can be secured to the merchandise may be another factor. Yet another factor may be the overall size or shape of the cable wrap security device. Large housings may detract from the aesthetic appeal of a particular package or the merchandise or may hide important information from a potential consumer. Also, any additional or new features of the cable wrap security device that improve or enhance the ability of the device to prevent unauthorized removal may be considered a benefit by a retail operator.

As explained in detail below, embodiments of the present invention provide a security device that may address one or more of the above features and functionality. For example, a security device may include a spool, locking mechanism, button, plug, and latch. The spool may be configured to either wind or unwind a cable for wrapping around an object. The locking mechanism may be configured to partially lock the spool. The button may be used to move the locking mechanism between locked and unlocked positions. The button may be blocked by inserting the plug into a housing of the device such that the button can not be activated to unlock the spool. The plug may be secured to the housing through the latch that prevents the unauthorized removal of the plug. For an enhanced locking feature, the latch and the plug may be configured to require at least two forces to move the latch and free the plug. The spool, locking mechanism, and button may be stacked along a common axis to provide a more compacted design.

In particular and according to the illustrated embodiment of FIGS. 1*a* through 2*c*, the security device 100 includes a first housing 110 and a second housing 120, a cable 130, and a plug 140. The cable 130 extends outwardly from the first housing through the second housing 120, through the plug 140, e.g., through an opening 465 defined by an outer end of the plug, back through the second housing 120 and back to the first housing 110. The routing of the cable 130 forms a plurality of loops. The first loop being defined from the first housing 110 through the second housing 120 to the plug 140 and the second loop being defined from the plug 140 through the second housing 120 back to the first housing 110.

As explained in more detail below, the plug 140 is movable between an inserted position, e.g., as shown in FIGS. 4*a* and 4*b*, in which at least a portion of the plug 140 extends through an opening 402 of the housing and into an interior 404 of the first housing and a removed position, in which the entire plug 140 is out of the first housing, e.g., as shown in FIGS. 2*a* and 4*c*. With the plug removed, the first and second loops of the cable are disconnected and the cable may be wrapped around the object 200. Once the cable is around the object 200, the plug 140 may be inserted into the first housing 110 with the security device being secured to the object 200 with the first and second cable loops, e.g., as shown in FIGS. 2*a* through 2*c*. One in the art would appreciate, in addition to securing the security device to the object, a dual loop embodiment, as illustrated, may also inhibit or prevent someone from tampering with the object, e.g., the object may be a package and the dual cable loops may prevent someone from being able to open the package to access the content.

In general, according to the illustrated embodiment, the first housing 110 contains a rotatable spool configured to loosen and tighten the cable 130 and the second housing 120 contains an EAS tag. However, the illustrated embodiment is an exemplary embodiment and not the exclusive embodiment. In other embodiments, rather than having two cable loops, the security device may include only a single cable loop. For example, the cable may extend from a first end secured to the spool within the housing out of the housing to a second end secured to the plug. In embodiments having a second housing, the cable may extend through the second housing. In other embodiments, the security device may only have a single housing. In such an embodiment, the EAS tag may be contained in the same housing as the spool. In other embodiments, the security device may not include an EAS tag.

Now, referring back to the illustrated embodiment and as best shown in FIGS. 1*a*, 2*c* and 3*b*, the second housing 120 may define an interior 300. For example, according to the illustrated embodiment, the second housing 120 includes a top portion 310 and a bottom portion 320. The top portion 310 may include a top surface 314 and a side wall 312 extending around the perimeter of the top surface 314 from a proximal end 316 to a distal end 318. The bottom portion 320 may include a bottom surface 322 that is connected to the distal end 318 of the side wall 312. Collectively the top surface 314, the side wall 312, and the bottom surface 322 define the interior 300 of the second housing 120.

The second housing 120 may define a plurality of holes 330, 332, 334, 336 configured to allow the cable to extend through the second housing, e.g., as shown in FIGS. 1*a*, 2*c* and 3*b*. The second housing 120 may also house or contain an EAS tag 340. More specifically, the EAS tag 340 may be contained within the interior 300 of the second housing 120. The top portion 310 and the bottom portion 320 may be permanently connected, e.g., with an adhesive, weld, or one or more fasteners, such that once the second housing 120 is assembled with the EAS tag 340, the EAS tag is inaccessible, including from consumers and would-be thieves.

Referring now to the first housing and the operation of the rotatable spool, embodiments of the security device may include the first housing 110, a spool 410, a locking mechanism 420, a button 430, the plug 140, and the cable 130. In general, according to the illustrated embodiment, the spool 410 is configured to unwind or wind the cable 130. The locking mechanism 420 is configured to selectively lock the spool 410 such that spool 410 is limited to winding the cable 130 and is prevented from further unwinding the cable 130. The button 430 is configured to unlock the spool 410 through the disengagement of the locking mechanism 420. And the plug 140 is configured to block out the button 430 such that the button 430 is prevented from unlocking the spool 410.

For example, as shown in FIGS. 4*a* through 4*c*, the spool 410 may be supported within the interior 404 of the first housing such that the spool 410 is rotatable in both a first direction and a second direction (i.e., clockwise and counterclockwise) about a first axis of the security device. A first end of the cable may be secured to the spool and the second end of the cable may be secured to or within the housing to an element not rotatably linked to the spool such that the rotation of the spool in the second direction may wind the cable around the spool and the rotation of the spool in the first direction may unwind the cable from the spool.

More specifically, according to the illustrated embodiment, the spool 410 has a cylindrical side wall 411 and two cylindrical flanges 412, 413 extending outwardly from the top and bottom of the side wall 411. The side wall 411 and flanges 412, 413 form a cylindrical channel in which a portion of the cable may be stored or held. The security device may further include a support post 440 configured to at least partially support the spool. For example, the support post 440 may be a cylindrical body 441 defining a groove 442 extending around its circumference. The spool 410 may define a central opening 414 to receive the cylindrical body 441 and may further include an inner rim 415 configured to engage the groove 442 of the support post. The spool 410 may also include an inner cylindrical wall 416 configured to extend around the cylindrical body 441.

During operation, according to the illustrated embodiment, the spool 410 may rotate about the cylindrical body 441 while the groove 442 and the inner rim 415 inhibit the movement of the spool 410 relative to the support post 440 along the first axis and in a direction perpendicular to the first axis. The spool may be further supported within the first housing by one or more surfaces of the first housing as long as such surfaces do not prevent the rotation of the spool within the first housing. As explained in more detail below, the spool 410 may further define one or more openings or channels 417, e.g., as best shown in FIG. 5*b*, configured to receive extensions of the locking mechanism. With the extensions of the locking mechanism extending at least partially through the one or more openings 417, the spool 410 and the locking mechanism are rotatably linked, i.e., the rotation of one causes the rotation of the other.

The locking mechanism 420 may be movable between a locked position (e.g., as illustrated in FIGS. 4*a* and 4*b*) and an unlocked position (e.g., as illustrated in FIG. 4*c*). In the locked position, the locking mechanism 420 is positioned or configured to prevent the rotation of the spool 410 in the first direction while not preventing the rotation of the spool 420 in the second direction. As a further example, the locking mechanism 420, in the locked position, may be positioned or configured to prevent the cable from being further extended out of the first housing or unwound from the spool and to not prevent the cable from being retracted or further wound around the spool and in the unlocked position, the locking mechanism may be positioned or configured such that it does not prevent the rotation of the spool in either direction, i.e., regardless if the cable is being wound or unwound around the spool.

The locking mechanism 420 of the illustrated embodiment is generally below the spool 410. Moreover, in the illustrated embodiment, both the spool 410 and the locking mechanism 420 are centered about the first axis. As best shown in FIG. 5*c*, the locking mechanism 420 may be generally shaped as a ring and define a central opening 423 configured to allow the support post 440 to extend through and to allow relative movement between the locking mechanism 420 and the support post 440 along the first axis of the security device. As mentioned above, the locking mechanism 420 may include one or more extensions 421. As an example, the locking mechanism 420 of the illustrated embodiment includes three extensions 421 extending upwardly. The locking mechanism 420 is positioned such that the extensions 421 are aligned with the openings 417 of the spool such that the extensions 421 extend through the openings 417 and rotatably link the locking mechanism 420 and the spool 410, e.g., as shown in FIGS. 4*a* thru 4*c*. The length of the extensions 421 may be long enough to ensure that the extensions 421 extend through the openings 417 both when the locking mechanism 420 is in the locked position and the unlocked position.

The locking mechanism 420 may further include downward facing locking teeth 424 extending along a bottom surface of the locking mechanism, e.g., as shown in FIG. 5*c*. While in the locked position, the locking teeth 424 of the locking mechanism may be positioned to engage a second set of locking teeth. For example and as shown in FIG. 5*d*, the first housing 110 may include a set of locking teeth 406 molded along a bottom portion of the first housing or the first housing may include an insert that includes a set of locking teeth and the insert may be positioned in a bottom portion of the first housing. When the first and second sets of the locking teeth 406, 424 are engaged the geometry of the first and second sets of the locking teeth 406, 424 prevent the relative rotational movement between the sets of teeth 406, 424 in one direction while allowing relative rotational movement between the sets of teeth 406, 424 in the other direction. Due to this capability, these locking teeth are sometimes referred to as one-way locking teeth. In the unlocked position, the teeth 424 of the locking mechanism are positioned away from the second set of the locking teeth 406 such the first and second sets of the locking teeth 406, 426 do not prevent the movement of the other.

The security device 100 may be configured to bias the locking mechanism 420 toward the locked position. For example and as shown in FIG. 3*a* and FIGS. 4*a* thru 4*c*, according to the illustrated embodiment, the security device 100 includes one or more biasing elements 450, such as coil springs. The biasing elements 450 may be positioned around the extensions 421 of the locking mechanism between the locking mechanism 420 and the spool 410. As the locking mechanism 420 is moved into the unlocked positioned, the distance between the locking mechanism 420 and the spool 410 is reduced and the biasing elements 450 are compressed. Due to the compression in the biasing elements 450, the biasing elements 450 exert a force onto the locking mechanism 420 encouraging the locking mechanism 420 toward the locked position. However, as explained below, a user may overcome this force by pushing on the button 430 such that the locking mechanism 420 remains in the unlocked position.

The button 430, according to the illustrated embodiment, is configured to move the locking mechanism 420 between the locked and unlocked positions. The button 430 may be positioned or configured to be at least partially accessible from the outside of the first housing 110 such that the button 430 can be activated, e.g., pushed, by a user. For example and as shown in FIGS. 4*a* thru 4*c*, according to the illustrated embodiment, the first housing 110 may define a bottom opening 308 allowing access to the button 430 when the security device is unattached from the object. As a more specific example, the first housing 110 may include a bottom surface 407 that defines the bottom opening 308. A bottom surface 431 of the button may be positioned near the bottom surface 407. In the illustrated embodiment, in the locked position, a bottom surface 431 of the button is flush with the bottom surface 407 of the first housing. In other embodiments, the bottom surface of the button may be below or above the below surface such that the button is still accessible to a user.

The button 30 further includes a top portion 432 positioned below or adjacent to the locking mechanism 420. For example, the top portion 432 may be directly below or adjacent a downward facing surface of the locking mechanism 420. As a user activates, e.g., pushes, the button 430, the button 430 is moved further into the first housing 110, e.g., along the first axis of the security device and as illustrated by the arrows in FIG. 4*c*, such that the top portion 432 of the button engages and moves the locking mechanism 420 upwards into the unlocked position, e.g., along the first axis of the security device. The movement of the locking mechanism 420 into the unlocked position disengages the two sets of locking teeth 406, 424.

As explained above, the plug 140 may be insertable at least partially into the first housing, e.g., through an opening 402 defined by the first housing. Moreover, in the inserted position, the plug 140 may be positioned or configured to prevent the movement of the button 430 such that the locking mechanism 420 is prevented from moving out of the locked position. In other words, as long as the plug 140 is in the inserted position, the locking mechanism 420 is prevented from moving out of the locked position via the button 430 and, thus, the cable or the cable loops can not be lengthened.

The plug 140 may extend from an inner end 461 to an outer end 462. The distance between the inner end 461 and the outer end 462 defines a length of the plug. The length of the plug may be configured to allow the plug to extend far enough into the interior of the first housing such that the inner end is at least to or beyond the button such that the at least a portion of the plug extends above at least a portion of the button. For example, in the illustrated embodiment, the button is spatially centered about the first axis of the security device and the plug may be configured to extend at least partially across the first axis in a generally perpendicular manner. The button 430 may also define a channel 433 that may be configured to receive the inner end 461 of the plug as the plug is moved inwardly to the inserted position. With the at least portion of the plug 140 above at least a portion of the button 430, the button 430 is prevented from moving upwardly further into the first housing 110.

The outer end 462 of the plug may be generally shaped to correspond with an outer wall of the first housing. For example, in the illustrated embodiment, the first housing 110 includes a generally cylindrical outer wall. The outer end 462 may define a cylindrical outer surface 409 that corresponds to the outer wall of the first housing. The length of the plug 140 may be configured such that in the inserted portion of the outer surface 409 of the outer end of the plug is or is substantially flush with the outer wall of the first housing, e.g., as shown in FIG. 1*a*. Such an arrangement may help to camouflage or otherwise blend in the plug such that it is less noticeable to a consumer or would-be thief.

The security device may further include a latch 470 movable between an engaged position and a disengaged position, e.g., as shown in FIGS. 4*a* thru 4*c*. In the engaged position, e.g., as shown in FIG. 4*a*, the latch 470 is positioned to prevent the plug 140 from being moved out of the inserted position, i.e., removed away from the first housing. In the disengaged position, e.g., as shown in FIGS. 4*b* and 4*c*, the latch 470 is positioned such that the latch 470 does not interfere with the movement of the plug 140 from the inserted positioned to the removed position. The security device may be further configured such that the latch 470 is biased toward the engaged position. Moreover, with the plug 140 in the inserted position, the security device may further be configured to prevent the latch 470 from being moved from the engaged position without a specifically configured key.

Due to the interactions between the spool 410, the locking mechanism 420, the button 430, the plug 140, and now the latch 470, one in the art would appreciate that by preventing the plug 140 from moving out of the inserted position through the positioning of the latch 470, the spool 410 is rotatable in only one direction. The one direction may be configured to be the winding direction of the cable, i.e., the direction that tightens the cable loops. Therefore, with the plug 140 inserted and the latch 470 in the engaged position, the security device is configured to allow the cable loops to be further tighten around the object while preventing the cable loops from loosening and reducing the likelihood that a consumer or a would-be thief could remove the security device from the object.

As a more specific example and according to the illustrated embodiment, the first housing define a vertical channel 401 configured to receive the latch 470 and a biasing device 480, such as a coil spring. The latch may be an elongated body extending from a top end 471 to a bottom end 472 made from a magnetic material, e.g., iron, nickel, or nickel-plated steel. The latch 470 may be shaped and positioned such that the latch may move up and down at least partially in the channel 401. The biasing device 480 may be positioned within the channel 401 between the top end 471 of the latch and a horizontal surface 405 of the first housing. As the latch 470 is moved toward the disengaged position, e.g., according to the illustrated embodiment, the latch is moved upwardly in the channel, the biasing device 480 is compressed causing the biasing device 480 to exert a force onto the top end 471 of the latch encouraging the latch 470 downwardly toward the engaged position. With the plug 140 in the inserted position, the latch 470, the biasing device 480, and the channel 401 may be inaccessible from outside the first housing such that a consumer or would-be thief can not insert a finger or tool to try to push, pull, or otherwise tamper with the latch 470 in order to try to get the latch 470 to move out of the engaged position.

Due to the magnetic properties of the latch, the latch 470 may be moved by a magnetic force. However, the latch 470 may be positioned within the first housing 110 and otherwise be configured to only be moveable by a magnetic force when that magnetic force has a certain strength or particular orientation relative to the latch. For example, in the illustrated embodiment, the latch 470 is moveable to the disengaged position by a specifically configured key being selectively placed next to the housing.

As an example, and as illustrated in FIGS. 6*a* thru 6*c*, the key 600 may include a magnet 606 and one or more placement knobs 602 configured to engage one or more placement indentations 403 defined on the side of the first housing. When the placement knobs 602 and the placement indentations 403 are aligned, the magnet of the key is positioned relative to the latch to create enough of a magnetic force to move the latch upwardly toward the disengaged position. The use of specifically configured key is to minimize the likelihood that consumer or would-be thief is able to move the latch using a more conventional or common magnet.

The security device may be further configured to include an impact resistant feature. In the event that the object and the security device were dropped in a particular way, the impact force may ordinarily move the latch 470 from the engaged position to the disengaged position at least temporarily which may lead to the unauthorized removal of the plug 140. The security device may be configured to require two forces to move the latch 470 from the engaged position to the disengaged position. The first force may be the use of the specifically configured key as discussed above. The second force may be applied by the user. The requirement of the second force may allow the security device to be more resistant to impact. Therefore, even if an impact serves as or otherwise eliminates the need of the first force, the requirement of the second force is likely to keep the plug inserted into the first housing.

For example and illustrated in FIGS. 4*a* thru 4*c* and 7, the outer end 462 of the plug may define an opening or channel 464 configured to receive at least the bottom end 472 of the latch when the plug 140 is in the inserted position and the latch 470 is in the engaged position. The outer end 462 may also define an inward facing slope surface 466. Between the inner end 461 and the inward facing slope surface 466, the plug may be smaller in the vertical direction than the distance between the bottom end 472 of the latch and the bottom of the opening 402 of the first housing. When the latch 470 is in the engaged position and the plug 140 is inserted into the opening 402 of the first housing, the plug 140 can fit between the bottom end 472 of the latch and the bottom of the opening 402. Once the inward facing slope surface 466 reaches the latch 470, the plug 140 reaches a point in which the inward facing slope surface 466 and the latch 470 make contact. As the plug 140 is further inserted, the interaction between the latch 470 and the inward facing slope surface 466 pushes the latch 470 upwards toward the disengaged position. Once the channel 464 of the plug reaches the bottom end 472 of the latch, the bottom end 472 of the latch drops into the channel 464 due to gravity and/or the biasing device 480.

The plug 140 may further include an extension, such as a lip 467, extending into the channel 464 and the latch 470 may include an opening 473 configured to receive or engage the lip 467. For example and as illustrated, the plug 140 may include a plastic molded piece 468 and an insert 469 that may be molded within or otherwise attached to the plastic molded piece. The insert may be configured to form the lip. According to the illustrated embodiment, as the bottom end 473 of the latch drops into the channel 464 during the plug insertion, at least a portion of the bottom end 472 of the latch drops below the lip 467. The plug 160 may be retracted (i.e., moved outwardly) slightly such that the lip 467 extends at least partially into the opening 473 of the latch. With the lip 467 extending over a portion of the latch 470, the latch 470 is prevented from moving upwardly even in response to the specifically configured key or an impact.

Retracting the plug 140 slightly such that the lip 467 extends at least partially into the opening 473 of the latch may occur during the normal loading operation of the security device. For example, the plug 140 may be inserted into the housing by a user, e.g., an employee of the retail establishment. The user may insert the plug as far as possible, e.g., until the inner end 461 abuts against an inner portion of the first housing. In this position, the latch is aligned with channel of the plug such that the latch moves at least partially into the channel. However, the lip 467 may not yet extend at least partially into the opening 473. Next, the user may tighten the cable around the object. As explained above, the cable may extend through the plug. Therefore, as the cable is tightened around the object, the cable pulls on the plug. The pulling force exerted on the plug by the tightening of the cable causes the plug to slightly retract which in turn causes the lip 467 to move at least partially into the opening 473.

As another example, instead of or addition to relying on the cable to retract the plug, a biasing device may be used. The biasing device may be configured to bias the plug to retract slightly once inserted into the first housing and with the portion of the bottom end of the latch in the channel of the plug.

To release the plug 140 of the illustrated embodiment, the user places the key 600 against the top side of the first housing 110 and pushes the plug 140 slightly inward such that the lip 467 is no longer in or otherwise engaging the opening 473 of the latch. With the lip 467 removed, the latch 470 is movable toward the disengaged position by the magnetic force provided by the key. Therefore, in the illustrated embodiment, the key provides the first force while the push from the user provides the second force.

The security device may further include a handle 150 configured to allow the user to rotate the spool 410. For example, according to the illustrated embodiment, the security device includes a top 160 and a handle 150. The first housing may include a top rim 112 that extends around and at least partially above the top 160 such that the top 160 is connected to the first housing. More specifically, in the illustrated embodiment, the top 160 is prevented from moving along or lateral to the first axis of the security device relative to the first housing 110 but is rotatable relative to the first housing 110. The top rim 112 may be connected permanently to the rest of first housing such that, once assembled, it would be difficult for a consumer or would-be thief to disassembly the security device.

The top 160 may be positioned or configured to cover the spool 410. Moreover, the top 160 may be rotatably connected to the spool. For example, the spool may include one or more openings 495, e.g., as shown in FIG. 5*b*, for receiving a portion, such as positioning blocks 496 of the top, e.g., as best shown in FIG. 5*a*. The handle 150 may be pivotally connected to the top 160 such that the handle 150 may be moved to a stored position, e.g., as shown in FIG. 1*a*, or a flipped-up position, e.g., as shown in FIG. 1*b*. As a more specific example and as shown in FIG. 3*a*, the handle 150 may be connected to the top 160 through one or more pins 494 extending through holes defined in the handle 150 and the top 160. A user may pivot the handle 150 to the flipped-up position and then twist the handle 150 in order to rotate the spool 410. As explained above, when the locking mechanism 420 is in the locked position, the user may be limited in that he or she may only be able to rotate the spool 410 in one direction such as the winding direction. When the locking mechanism 420 is in the unlocked position, the user may be able to rotate the spool in either direction.

The security device may further include a winder mechanism. In particular and as further described in U.S. patent application Ser. No. 12/027,297, which has been incorporated by reference and to which the present application claims priority, the security device may include a winder mechanism that biases the spool to a first position. The first position may correspond to a position in which the cable is completely wound around the spool or that the cable loops have a minimum length. The winder mechanism may include a torsion spring extending from a first end to a second end. The torsion spring may be positioned within the center opening of the spool with the first end attached to the spool and the second end attached to a non-rotating element, such as the first housing. In the first position of the spool, the torsion spring may be at rest or in a rest state. As the spool is rotated to unwind the cable, the spring is twisted. The more the spool is rotated the further the spring is twisted. The torsion spring is configured to return to its rest state. Due to the connection between the torsion spring and the spool; the torsion spring is also configured to return the spool to the first position. Therefore, without a counter force, the torsion spring is configured to move the spool back to the first position and, thus, wind the cable back up.

As indicated above, the security device may include an EAS tag 340 that is configured to be detectable when the EAS tag is present in a predetermined detection zone, e.g., set up at or near the door or other entrance point of the retail establishment. EAS tag may be configured to work within an EAS security system. For example, the EAS tag may a magnetic tag such as in an electromagnetic (EM) system or in an acousto-magnetic (AM) system or an electronic circuit and antenna as in a radio frequency (RF) system. As another example, the EAS tag may be configured work within a microwave system.

In addition to or instead of the EAS tag, the security device may include other wireless devices. For example, the security device may include an active or passive RFID tag. The RFID tag may be used to store and/or communicate information about the object for security or inventory control purposes.

The security device may also be configured with other security or alarm features. For example, the security device may have an audio alarm, such as a piezo-electric siren, that may be triggered in response to one or more circumstances. In the illustrated embodiment, the alarm may include a printed circuit board 497, a light-emitting diode (LED) 498, and a battery 499. The battery 499 may stored and positioned within a top cavity defined by the spool 410. The printed circuit board 497 may be positioned above the battery. The LED may in electrical communication with the printed circuit board 497 and the battery 499 and may extend at least partially through in an opening defined by the top 491 of the security device such that at least a portion of the LED is visible outside the first housing 110. The LED may be used as an indicator (e.g., by providing a constant light or a blinking on/off light) of the existence of a particular condition or circumstance, e.g., security device has power, the locked mechanism is the locked position, the plug is in the inserted position, the latch is in the first position, the alarm is armed, or that the alarm has been triggered.

As explained in more detail in U.S. Pat. No. 7,497,101, which has been incorporated by reference, the alarm of the security device may be configured to activate in the event that a portion of the cable has been compromised, such as being cut or damaged. For example, the cable may be electrically conductive and form a sense loop in contact with a trigger of the security device. In event that the cable is compromised, the trigger is configured to detect the change in the cable and respond by activating the alarm.

As another example, the trigger may be configured to excite and, thus, activate the alarm depending on the location of the EAS tag to the gates of the security system. In one embodiment, the trigger may be configured to activate the alarm once the EAS tag is near, at, or beyond the gate which should help the employees to detect the merchandise with the attached security device. Therefore, in some embodiments, the security device may have three alarm features, e.g., the gates themselves alarming when the EAS tag is detected, the audible alarm of the security device itself triggering when its cable is compromised or otherwise tampered with, and the audible alarm of the security device triggering when the EAS tag is at, near, or beyond the security gates.

As discussed above, embodiments disclosed herein provide a security device. The security device may have a relatively compact design. For example, in the illustrated embodiment, the spool rotatable about the first axis of the security device and the locking mechanism and the button movable along the first axis of the security device. Moreover, each of the spool, the locking mechanism, and the button may be spatially centered about the first axis of the security device and the plug may be generally extend perpendicular to and through the first axis of the security device to prevent the relative movement between the spool, the locking mechanism, and the button along the first axis of the security device. Such an arrangement, i.e., a common axis (such as the first axis) between the spool, locking mechanism, and button and a plug for blocking a locking mechanism configured to move perpendicular to the common axis and between the button and the locking mechanism, allows for a relative compact design compared to some conventional security devices.

In the illustrated embodiment, the button is positioned on the bottom side of the housing. Placing the button on the bottom side of the housing may be considered unconventional because in such a location one would think that the merchandise is likely to inadvertently activate the button as the button is placed near or in direct contact with the merchandise. However, as discussed above, the plug is configured to block the activation of the button which minimizes an inadvertent activation by the merchandise. Moreover, in such a position, the button is inaccessible (and, thus, more tamper resistant) to consumers and would-be thief when the security device is secured to the object. Although the position of the button prevents inadvertent and unauthorized activation, the presence of the button still provides a relatively easy means for the employees of the retail establishment to use the security device.

As discussed above, the security device may also include an impact-resistant feature making it more difficult for a would-be thief to circumvent the locking features of the security device. Also, in the illustrated embodiment, the security device includes two sets of locking teeth extending along a perimeter of the locking mechanism which provides a relatively larger locking surface and, thus, improved locking structure, compared to some conventional security devices. One skilled in the art would appreciate the other improvements and enhancements that the security device, according to embodiments of the present invention, provides over some of the conventional security devices.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A security device structured for attachment to an object, the security device comprising:

a housing;

a spool rotatably supported within the housing such that the spool is rotatable in both a first direction and a second direction;

a locking mechanism movable between a locked position and an unlocked position, in the locked position, the locking mechanism is positioned to prevent the spool from rotating in the first direction while not preventing the spool from rotating in the second direction and, in the unlocked position, the locking mechanism is positioned to not prevent the spool from rotating in the first direction or in the second direction;

a button accessible from outside of the housing when the security device is unattached to the object and configured to move the locking mechanism between the locked position and the unlocked position;

a plug movable between an inserted position and a removed position, in the inserted position, at least a portion of the plug is positioned to prevent the button from moving the locking mechanism out of the locked position and, in the removed position, the plug is positioned to not prevent the button from moving the locking mechanism out of the locked position; and a latch movable between an engaged position and a disengaged position, in the engaged position, at least a portion of the latch is positioned to prevent the plug from moving toward the removed position and, in the disengaged position, the latch is positioned to not prevent the plug from moving toward the removed position.

2. The security device according to claim 1, wherein the latch, in the engaged position, and the plug, in the inserted position, are configured to require a first force and a second force to move the latch from the engaged position toward the disengaged position.

3. The security device according to claim 1 further comprising a cable configured to form at least one cable loop extending from the housing and to at least the plug, a first end of the cable being connected to the spool and a second end of the cable being secured such that a rotation of the spool in the first direction lengthens the cable loop and a rotation of the spool in the second direction shortens the cable loop.

4. The security device according to claim 1, wherein the button is positioned to be inaccessible once the security device is attached to the object.

5. The security device according to claim 1, wherein each of the spool, the locking mechanism, and the button share a common axis about which the spool, the locking mechanism, and the button are spatially centered.

6. The security device according to claim 5, wherein the locking mechanism is moveable along the common axis.

7. The security device according to claim 6, wherein, in the inserted position, the plug is generally perpendicular to the common axis.

8. The security device according to claim 7, wherein, the latch is moveable along an axis parallel to the common axis.

9. The security device according to claim 1 further comprising an EAS tag.

10. The security device according to claim 8 further comprising an audio alarm.

11. The device according to claim 10 further comprising a second housing, the first housing contains the audio alarm and the second housing contains an EAS tag.

12. A security device structured for attachment to an object, the security device comprising:

a housing;

a spool rotatably supported within the housing such that the spool is rotatable in both a first direction and a second direction about a first axis;

a handle for rotating the spool;

a locking mechanism movable along the first axis between a locked position and an unlocked position, in the locked position, the locking mechanism is positioned to prevent the spool from rotating in the first direction while not preventing the spool from rotating in the second direction and, in the unlocked position, the locking mechanism is positioned to not prevent the spool from rotating in the first direction or in the second direction;

a button accessible from outside of the housing when the security device is unattached from the object, movable along the first axis, and configured to move the locking mechanism between the locked position to the unlocked position; and a plug movable between an inserted position and a removed position, in the inserted position, at least a portion of the plug is positioned to prevent the button from moving the locking mechanism out of the locked position and, in the removed position, the plug is positioned to not prevent the button from moving the locking mechanism out of the locked position.

13. The security device according to claim 12 further comprising:

a cable configured to form at least one cable loop extending from the housing and to at least the plug, a first end of the cable being connected to the spool and a second end of the cable being secured such that a rotation of the spool in the first direction lengthens the cable loop and a rotation of the spool in the second direction shortens the cable loop; and a latch movable between an engaged position and a disengaged position, in the engaged position, at least a portion of the latch is positioned to prevent the plug from moving toward the removed position and, in the disengaged position, the latch is positioned to not prevent the plug from moving toward the removed position.

14. The security device according to claim 13, wherein the latch, in the engaged position, and the plug, in the inserted position, are configured to require a first force and a second force to move the latch from the engaged position toward the disengaged position.

15. The security device according to claim 14, wherein, in the inserted position, the plug is generally perpendicular to the first axis.

16. A security device structured for attachment to an object, the security device comprising:

a housing;

a spool rotatably supported within the housing such that the spool is rotatable about a first axis in both a first direction and a second direction;

a locking mechanism movable between a locked position and an unlocked position, in the locked position, the locking mechanism is positioned to prevent the spool from rotating in the first direction while not preventing the spool from rotating in the second direction and, in the unlocked position, the locking mechanism is positioned to not prevent the spool from rotating in the first direction or in the second direction;

a button accessible from outside of the housing when the security device is unattached to the object, movable and configured to move the locking mechanism between the locked position and the unlocked position; and a plug movable between an inserted position and a removed position, in the inserted position, the plug extends generally perpendicular to the first axis and between the button and the locking mechanism such that the button is prevented from moving the locking mechanism out of the locked position and, in the removed position, the plug is positioned to not prevent movement of the button.

17. The security device according to claim 16, wherein each of the locking mechanism and the button is moveable along the first axis.

18. The security device according to claim 16 further comprising a latch movable between an engaged position and a disengaged position, in the engaged position, at least a portion of the latch is positioned to prevent the plug from moving toward the removed position and, in the disengaged position, the latch is positioned to not prevent the plug from moving toward the removed position; the latch, in the engaged position, and the plug, in the inserted position, are configured to require a first force and a second force to move the latch from the engaged position toward the disengaged position.

19. The security device according to claim 16 further comprising a handle for rotating the spool and a cable configured to form at least one cable loop extending from the housing and to at least the plug, a first end of the cable being connected to the spool and a second end of the cable being secured such that a rotation of the spool in the first direction lengthens the cable loop and a rotation of the spool in the second direction shortens the cable loop.

20. The security device according to claim 16 further comprising an EAS tag and a second housing that contains the EAS tag.

21. The security device according to claim 16 further comprising an audible alarm.

* * * * *